US005798606A

United States Patent [19]

Koga et al.

[11] Patent Number: 5,798,606

[45] Date of Patent: Aug. 25, 1998

[54] DEFLECTION YOKE HAVING AN IMPROVED PROTECTION COVER FOR PROTECTING A TERMINAL BOARD

[75] Inventors: Takasuke Koga; Keiji Morimoto; Naoki Hatakeyama, all of Ibaraki-ken, Japan

[73] Assignee: Victor Company of Japan, Ltd., Yokohama, Japan

[21] Appl. No.: 794,377

[22] Filed: Feb. 4, 1997

[30] Foreign Application Priority Data

Feb. 5, 1996 [JP] Japan ..... 8-044293

[51] Int. Cl.[6] ..... H01J 29/70

[52] U.S. Cl. ..... 313/440

[58] Field of Search ..... 313/421, 433, 313/440; 335/210, 209, 213, 296, 297; 348/829

[56] References Cited

FOREIGN PATENT DOCUMENTS 61-269836 11/1986 Japan .
7-19940/95 4/1995 Japan .

*Primary Examiner*—William L. Oen
*Attorney, Agent, or Firm*—Michael N. Meller

[57] ABSTRACT

A deflection yoke 200 is comprised of a pair of separators 1, 1 formed in a funnel shape, having a large brim and a small brim. A first flange 1*a* is formed on the small brim, and a second flange 1*b* is formed on the large brim. A substrate 5 is held by at least one of the first flange and the second flange. A protective cover 26 is provided for protecting the substrate independently from the substrate by being held to the first flange and the second flange.

13 Claims, 26 Drawing Sheets

DEFLECTION YOKE HAVING AN IMPROVED PROTECTION COVER FOR PROTECTING A TERMINAL BOARD

BACKGROUND OF THE INVENTION

1. Field of the Invention

The present invention relates to a deflection yoke provided with a terminal board for connecting lead wires and a substrate provided with circuit parts, and particularly to a deflection yoke improved by providing a protection cover for protecting the terminal board.

2. Description of the Related Art

FIG. 1 shows a partially cutaway side view of a of a prior art deflection yoke 100.

In FIG. 1, the deflection yoke 100 is formed into a funnel shape, provided by a pair of separators 1, 1, having a large brim 1*b* and a small brim 1. The large brim of the deflection yoke 100 is arranged at the screen side (front) of a cathode ray tube, and the small brim thereof is directed to a rear of the cathode ray tube.

A pair of saddle type horizontal deflection coils 2, 2 is provided on the inner side of the pair of separators 1, 1 and a pair of saddle type vertical deflection coils 3, 3 is provided on the outer side of the pair of separators 1, 1. The pair of separators 1, 1 electrically insulates and holds the pair of horizontal deflection coils 2, 2 and the pair of vertical deflection coils 3, 3. A pair of cores 4, 4 made of ferrite, for example, is provided on respective outer sides of the pair of vertical deflection coils 3, 3.

The conventional deflection yoke 100 shown in FIG. 1, needs an electronic circuit for compensating a deflection characteristic of the cathode ray tube. A substrate 5 bearing the compensation circuit is provided on one of the pair of separators 1, 1. A protective cover 6, made of an insulating material, covers the substrate 5 which has a high voltage applied thereto.

A first flange 1*a*, comprising a plurarity of flanges 1*a*1, 1*a*2, 1*a*3, is formed on the rear of the pair of separators 1, 1. A second flange 1*b* is formed on the screen side of the pair of separators 1, 1. A pair of compensation coils 7, 7, called 4P coils, is mounted on the flange 1*a*1, located nearest to the neck of the cathode ray tube. A pair of hooks 8*a*, 8*b* for mounting the substrate 5 to the separator 1, is formed integrally with the flange 1*a*3, positioned closest to the screen of the cathode ray tube in the first flange 1*a*.

A plurarity of pins 9 for connecting lead wires is mounted on the substrate 5. A lead wire 7*a* from the compensation coil 7, a lead wire 2*a* from the horizontal deflection coil 2, and a lead wire 3*a* from the vertical deflection coil 3 are connected and soldered to the pins 9 respectively. They are thus connected electrically and mechanically to the substrate 5. After the connection of the lead wires 2*a*, 3*a*, and 7*a*, the protective cover 6 is mounted on the substrate 5.

FIG. 2 shows a partially cutaway view of the prior art deflection yoke.

FIG. 2 is a perspective view of a rear part of the deflection yoke 100 shown in FIG. 1, wherein a part of the protective cover 6 is cut away for illustration.

A method for connecting the lead wire 7*a* to the pin 9 will be explained referring to FIG. 2.

In FIG. 2, the lead wire 7*a* is connected to the pin 9 under the protective cover 6 and through a notch 5*a* formed on the edge of the substrate 5 and away from the hooks 8*a* and 8*b*. The lead wire 7*a* uses the shortest route to the pin 9 without slack.

A method of mounting the substrate 5 to the separator 1 is explained referring to FIG. 3.

FIG. 3 shows a partial perspective view of the deflection yoke of the prior art.

As shown in FIG. 3, the substrate 5 has holes 5*b*, 5*b*, 5*c*, 5*c* for engaging the hooks 8*a*, 8*a*, 8*b*, 8*b* of the flange 1*a*3 therewith. The substrate 5 is mounted on the separator 1 by matching the holes 5*b*, 5*b*, 5*c*, 5*c* to the hooks 8*a*, 8*a*, 8*b*, 8*b* respectively and pushing them therein.

FIG. 4 shows a partial cutaway side view for explaining the assembly of the protective cover 6 to the first flange 1*a*.

The protective cover 6 is formed in the shape of an open box. A plurarity of hooks 6*a* is formed integrally with and elastically on the protective cover 6. Ribs 6*b*, 6*b* are formed on the high and low ends of the protective cover 6, while ribs 6*c*, 6*c* are formed on each of the side walls of the protective cover 6, and located in the mid portion thereof.

As shown in FIG. 4, when the protective cover 6 is placed on the substrate 5, the substrate 5 is held manually in the direction of "B", and the protective cover 6 is pushed in the direction of "A". As shown in FIG. 5, the hook 6*a* of the protective cover 6 is pressed to the edge of the substrate 5, and bent upwardly, as shown by a two-dot chain line. Then, the edge of the substrate 5 nests in a space 6*d* formed by the hook 6*a* and the rib 6*b*. As a result, the substrate 5 holds, and is enclosed within the protective cover 6.

The deflection yoke 100, as explained and shown in FIG. 1, is a deflection yoke having a cantilever structure, wherein the substrate 5 is held by one of the flanges, the first flange 1*a*. This cantilever structure is common with a small substrate having a length with is shorter than the distance between the first flange la and the second flange 1*b*.

FIG. 6 shows a partial cutaway view of a deflection yoke holding a substrate by both ends thereof.

The substrate 15 of a deflection yoke 101, having a length longer than the distance between the first flange 1*a* and the second flange 1*b*, is commonly held by both ends thereof.

A deflection yoke 101 holding a substrate by both ends thereof will be explained hereinafter.

Deflection yokes 100, 101 shown in FIG. 1 and FIG. 6 respectively are different only in the size of the substrate and the construction of the holding mechanism of the substrate. Thus, an explanation will be given mainly to the these differences.

A substrate 15 extending from the first flange 1*a* to the second flange 1*b*, is held on the side of the separator 1. A hook 8*c* for holding the substrate 15 is formed integrally with the flange 1*a*3. A plurarity of pins 9 for connecting lead wires is mounted on the substrate 15, similarly to the substrate 5 as shown in FIG. 1. A lead wire 7*a* from the compensation coil 7, a lead wire 2*a* from the horizontal deflection coil 2, and a lead wire 3*a* from the vertical deflection coil 3 are connected and soldered to the pins 9 respectively. They are thus, connected electrically and mechanically to the substrate 15. After the connection of the lead wires 2*a*, 3*a*, and 7*a*, a protective cover 16 is mounted on the substrate 15.

FIG. 7 shows a partial side view of a deflection yoke of the prior art.

A mounting method of the substrate 15 on the separator 1 will be explained referring to FIG. 7. Ribs 10*a*, 10*b*, for holding the edge of the substrate 15, are integrally formed with the second flange 1*b*. The edge of the substrate 15 nests in the space formed by the ribs 10*a* and 10*b*.

The substrate 15 has a hole 15*b* adapted to engage a hook 8*c* of the flange 1*a*3. After nesting of the substrate 15 in the space formed by the ribs 15*a* and 15*b*, the substrate 15 is pushed in the direction of the arrow to the separator 1 to engage the hook 8*c* as shown by a two-dot chain line.

FIG. 8 shows a perspective view of the prior art.

In FIG. 8, a protective cover 16 is ready to be mounted on the substrate 15. The protective cover 16 is formed as an open box. An open area of the protective cover 16 is formed almost equal to or slightly larger than the substrate 15. A plurarity of hooks 16*a* are integrally and elastically formed on the four edges of the open area of the protective cover 16. Ribs 16*b*, 16*c* (not shown), which are the same as the ribs 6*b*, 6*c* in FIG. 4, are formed inside of the protective cover 16. A space, equal to the thickness of the substrate 15, is formed between the rib 16*b* and the hook 16*a*.

As shown in FIG. 8, the hook 16*a* of the lower end of the protective cover 16 as viewed is engaged first with the lower end of the substrate 15. Then the upper end of the protective cover 16 is pushed in the direction of the arrow "A". The upper end of the substrate 15 nests in the space formed by the hook 16*a* and the rib 16*b*. Thus, the substrate 15 holds the protective cover 16 and is enclosed thereby.

Mounting practices of the protective cover on the substrate bearing electronic devices described above, and, a protective cover is fitted, in the same manner as explained before, to a terminal board for terminating lead wires.

As shown in FIG. 1, the deflection yoke 100 having a cantilever structure tends to cause problems easily when the cover 6 is mounted on the substrate 5 or the deflection yoke 100 is carried. A stress applied in the direction of "A" in FIG. 4, to the substrate 5 damages it or the hooks 8*a*, 8*b* of the first flange 1*a*, or causes the hooks 8*a*, 8*b* to disengage from the substrate 5. Further, as shown in FIG. 9 by the two-dot chain line, the substrate 5 rotates around the hooks 8*a*, 8*b* as a pivot, by a force in the arrow indicated direction. Then, a lead wire 7*a* wired to the pin 9 from the compensation coil 7 is cut by a pulling force.

The deflection yoke 100 of the prior art of FIG. 1 has the above mentioned problems. Thus, a production process must be done carefully so as not to damage the substrate 5, the hooks 8*a*, 8*b*, and the protection cover 6 must be attached to the substrate 5 carefully so as not to cut the lead wire 7*a*.

The deflection yoke 101 holding the substrate 15 by both ends as shown in the prior art of FIG. 6 has problems as follows.

As shown in FIG. 6, the deflection yoke 101 holding the substrate 15 by both ends can be damaged easily by mounting the cover 16 on the substrate 15 or seizing the deflection yoke 101 for carrying because of the stress applied in the direction of "A" shown in FIG. 8, to the hook 8*c* of the first flange 1*a*. Causing the hook 8*c* to break or come off from the substrate 15 or the substrate 15 to break.

Accordingly, the protective cover 16 must carefully be set to the substrate 15 so as not to damage the substrate 15 and the hook 8*c*, and, as a result, the productivity decreases.

SUMMARY OF THE INVENTION

The object of the present invention is to provide a deflection yoke capable of reducing a damage in production to a substrate, the terminal board, without causing a hook coming off from the substrate, breakage of the substrate, the terminal board, and the hook, or cutting a lead wire connected to the terminal board or the substrate, and, moreover, to provide a deflection yoke capable of mounting the protective cover easily on the substrate.

According to the present invention, the above object may be achieved by providing a deflection yoke including a separator formed into a funnel shape, having a first flange formed near a small brim, a second flange formed near a large brim, a substrate mounted on at least one of the first flange and the second flange, a protective cover for protecting the substrate, a first coupling device for coupling the protective cover to the first flange, and a second coupling device for coupling the protective cover to the second flange.

According to the present invention, the above object may be achieved by providing another deflection yoke including a separator formed into a funnel shape, having a first flange formed near a small brim, a second flange formed near a large brim, a substrate mounted on at least the first flange or the second flange, a protective cover for protecting the substrate, a first coupling device formed on the first flange or the second flange for coupling the protective cover to a corresponding flange, a second coupling device formed on the flange on which the first coupling device is not formed, for coupling the protective cover to another corresponding flange.

DETAILED DESCRIPTION OF THE PREFERRED EMBODIMENT

Figure 1:
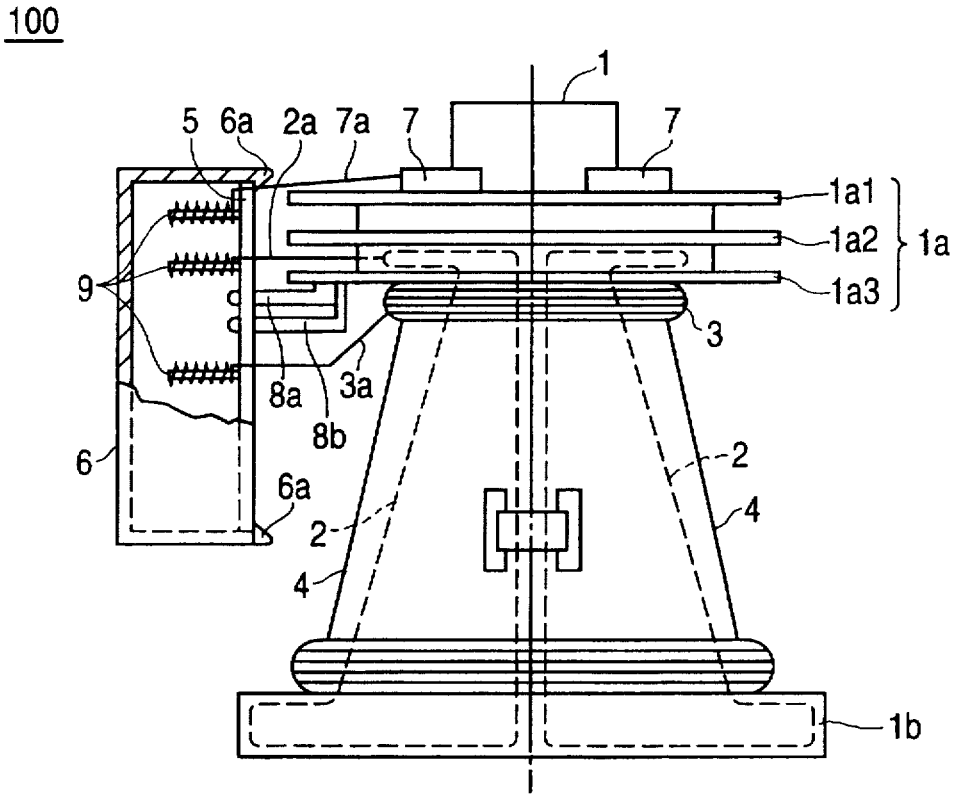
Fig. 1 PRIOR ART
FIG. 1 shows a partially cutaway side view of a deflection yoke of the prior art.
Figure 2:
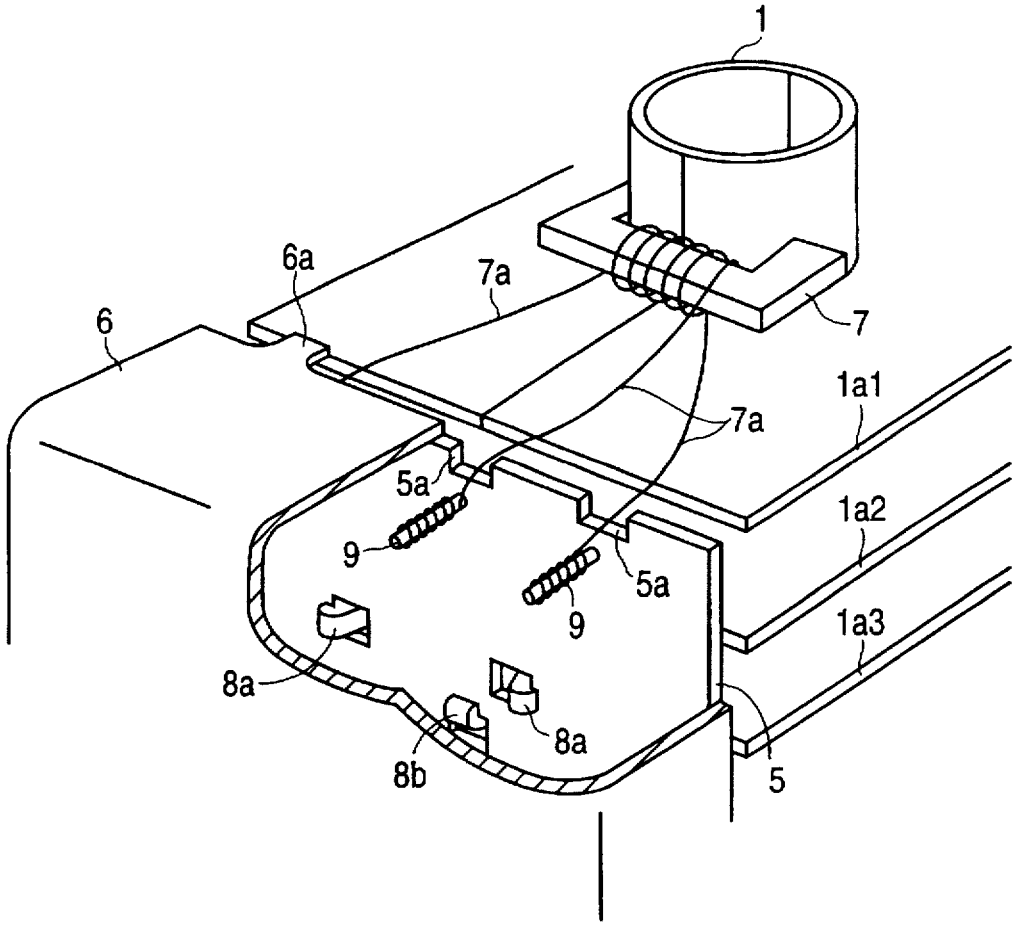
Fig. 2 PRIOR ART
FIG. 2 shows a partially cutaway view of a rear part of the deflection yoke of the prior art shown in FIG. 1.

A deflection yoke according to the present invention will be described in detail with reference to accompanying drawings, in which same reference numerals and symbols are used to denote like or equivalent elements used in the aforementioned prior arts, and detailed explanation of such elements are omitted for simplicity.

[1st Embodiment]

Figure 10:
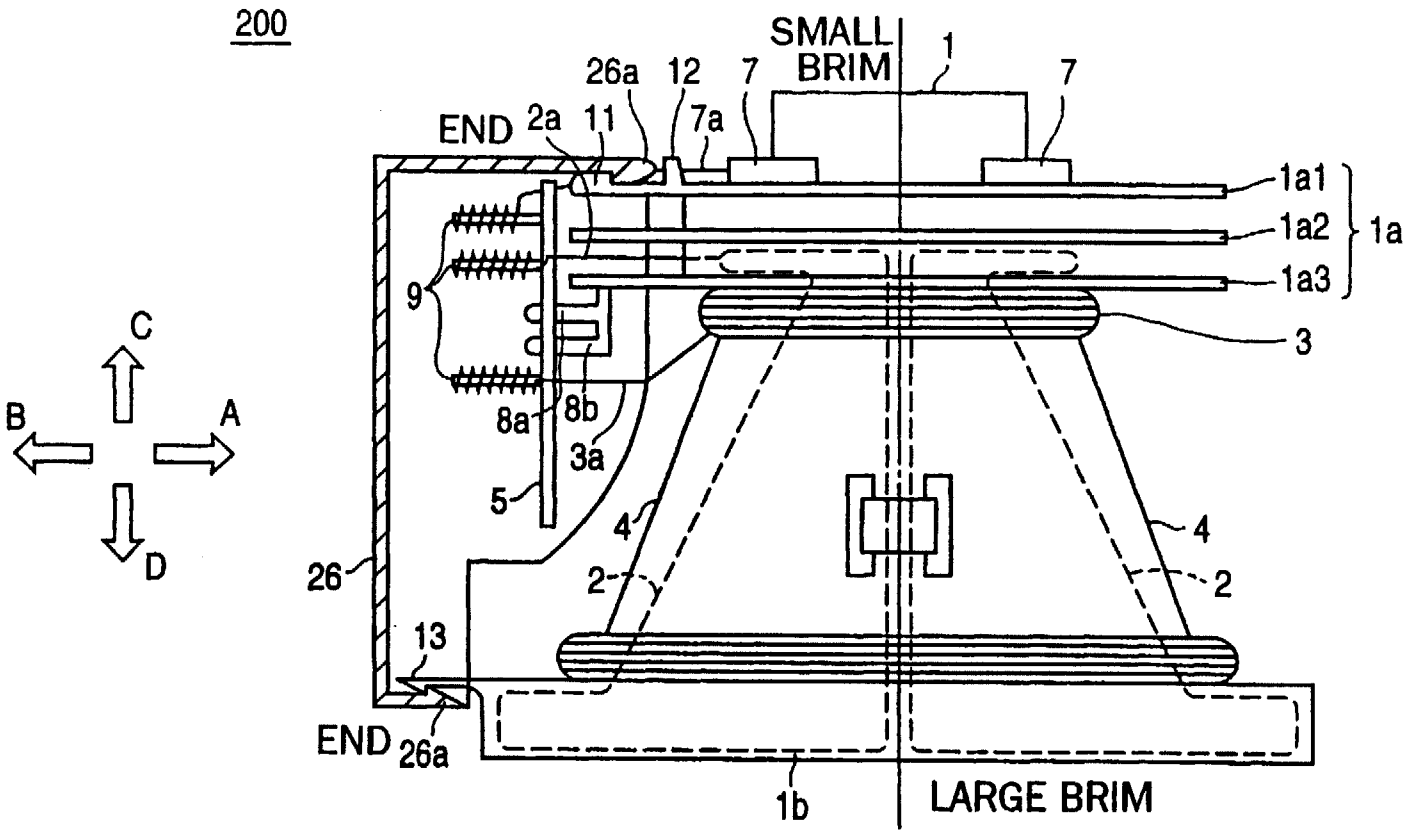
FIG. 10 shows a partial cutaway side view of a deflection yoke of the present invention.

FIG. 10 shows a partial cutaway side view of a deflection yoke of the present invention.

Figure 11:
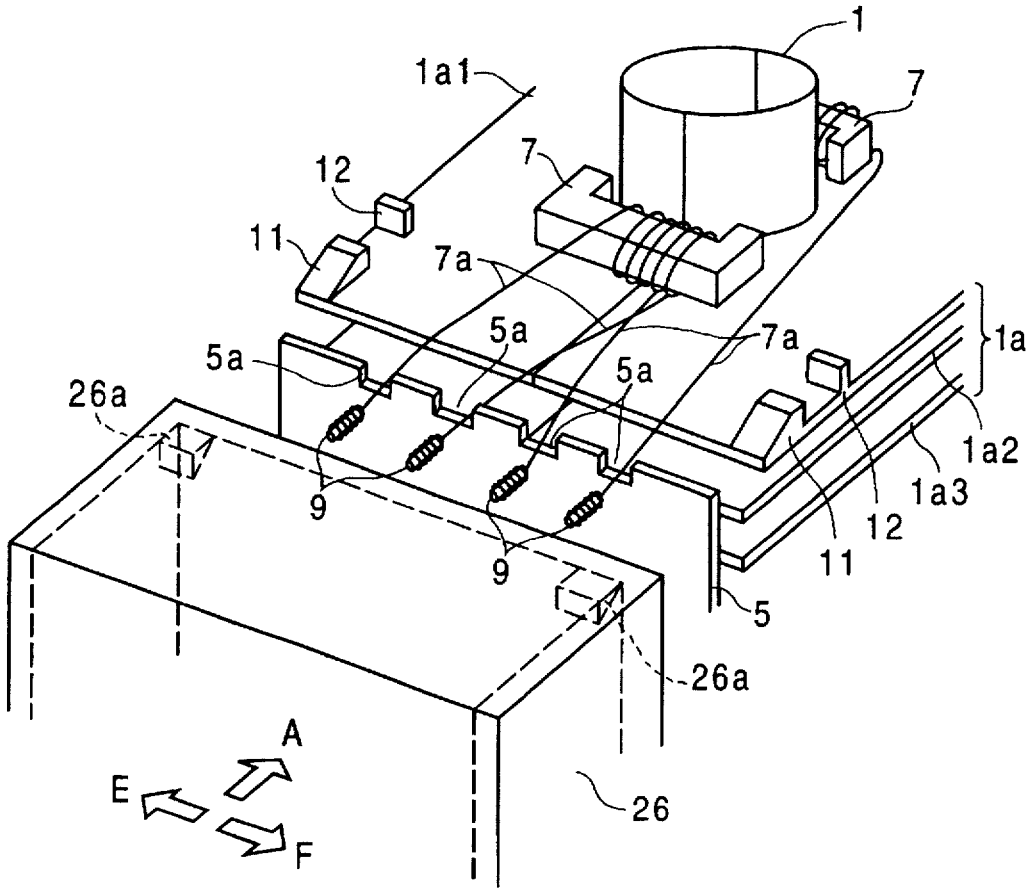
FIG. 11 shows a partial perspective view of the deflection yoke of the present invention.

FIG. 11 shows a partial perspective view of the deflection yoke of the present invention.

Figure 12:
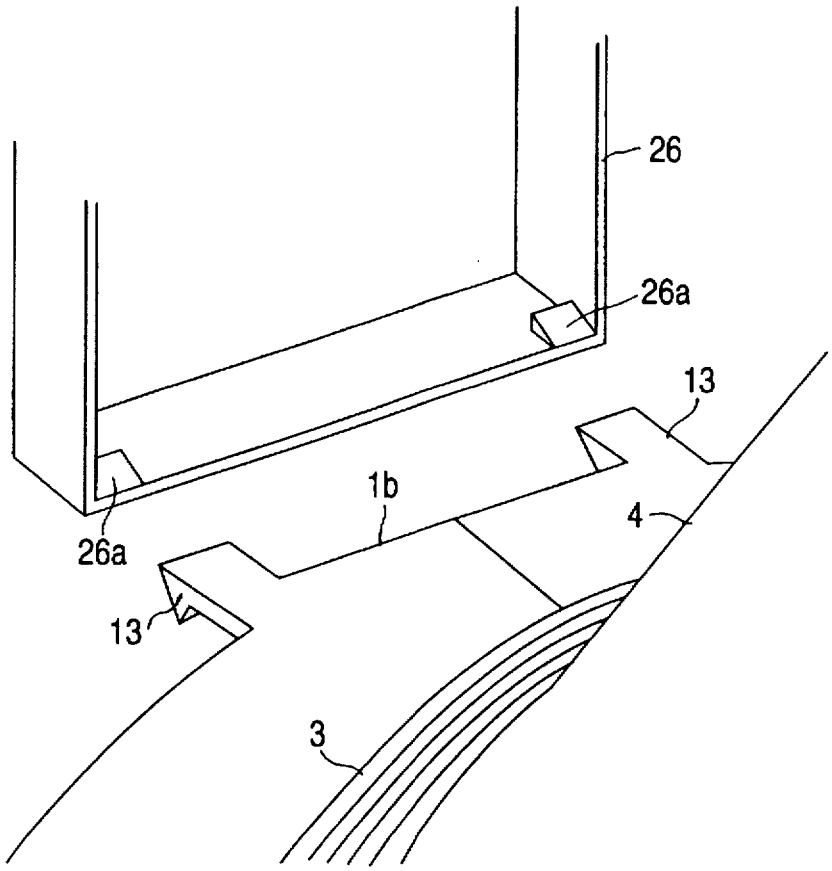
FIG. 12 shows a partial perspective view of the deflection yoke of the present invention in a modified form.

FIG. 12 shows a partial perspective view of the deflection yoke of the present invention in a modified form.

A deflection yoke 200 of a cantilever structure will be explained referring to FIG. 10.

In FIG. 10, the deflection yoke is formed into a funnel shape, provided with a pair of separators 1, 1 having a large brim and a small brim. A large brim of the deflection yoke 200 is positioned to the front (screen) side of a cathode ray tube, and a small brim thereof is positioned to the rear of saddle type the cathode ray tube.

A pair of horizontal deflection coils 2, 2 is placed inside a pair of separators 1, 1 and a pair of saddle type vertical deflection coils 3, 3 is set to the outer side of the pair of separators 1, 1. The pair of separators 1, 1 electrically insulates and holds the pair or horizontal deflection coils 2, 2 from the pair of vertical deflection coils 3, 3. A pair of cores 4, 4 made of ferrite, for example, is provided at respective outer sides of the pair of vertical deflection coils 3, 3.

The deflection yoke 200, has an electronic circuit for compensating a deflection characteristics of the cathode ray tube. A substrate 5 carrying the electronic circuit for performing compensation of the deflection characteristics is provided on a side of one of the pair of separators 1, 1. A protective cover 26 made of an insulating material for physically protecting the electronic circuit and preventing an electric shock hazard, is mounted on the substrate 5.

The protective cover 26 is attached to the separator 1 by a method to be explained and protects the substrate 5 by covering it.

A first flange 1*a*, comprising a plurarity of flanges 1*a*1, 1*a*2, 1*a*3, is formed on the rear of the pair of separators 1, 1. A second flange 1*b* is formed on the front of the pair of separators 1, 1. A pair of compensation coils 7, 7, called 4P coils, is provided on the flange 1*a*1, located nearest to the neck of the cathode ray tube. Hooks 8*a*, 8*b* for mounting the substrate 5 on the separator 1, are formed integrally with the flange 1*a*3, positioned closer to the screen of the cathode ray tube in the first flange 1*a*.

A plurarity of pins 9 for connecting lead wires are mounted on the substrate 5. A lead wire 7*a* from the compensation coil 7, a lead wire 2*a* from the horizontal deflection coil 2, and a lead wire 3*a* from the vertical deflection coil 3 are connected to the pins 9 respectively. The lead wires 7*a*, 2*a* and 3*a* are connected mechanically and electrically by soldering to the substrate 5 respectively. After the connection of the lead wires 2*a*, 3*a*, and 7*a*, the protective cover 26 is mounted on the separator 1.

A method for connecting the lead wire 7*a* to the pin 9 will be explained referring to FIG. 11.

FIG. 11 shows a partial perspective view of the deflection yoke of the present invention shown in FIG. 10, and shows that the protective cover 26 is about to be mounted on the separator 1.

In FIG. 11, the lead wire 7*a* is connected to the pin 9 through a space formed between the protective cover 26 and a notch 5*a* formed on the edge of the substrate 5 near the neck, and is routed to the pin 9 without any slack.

Figure 3:
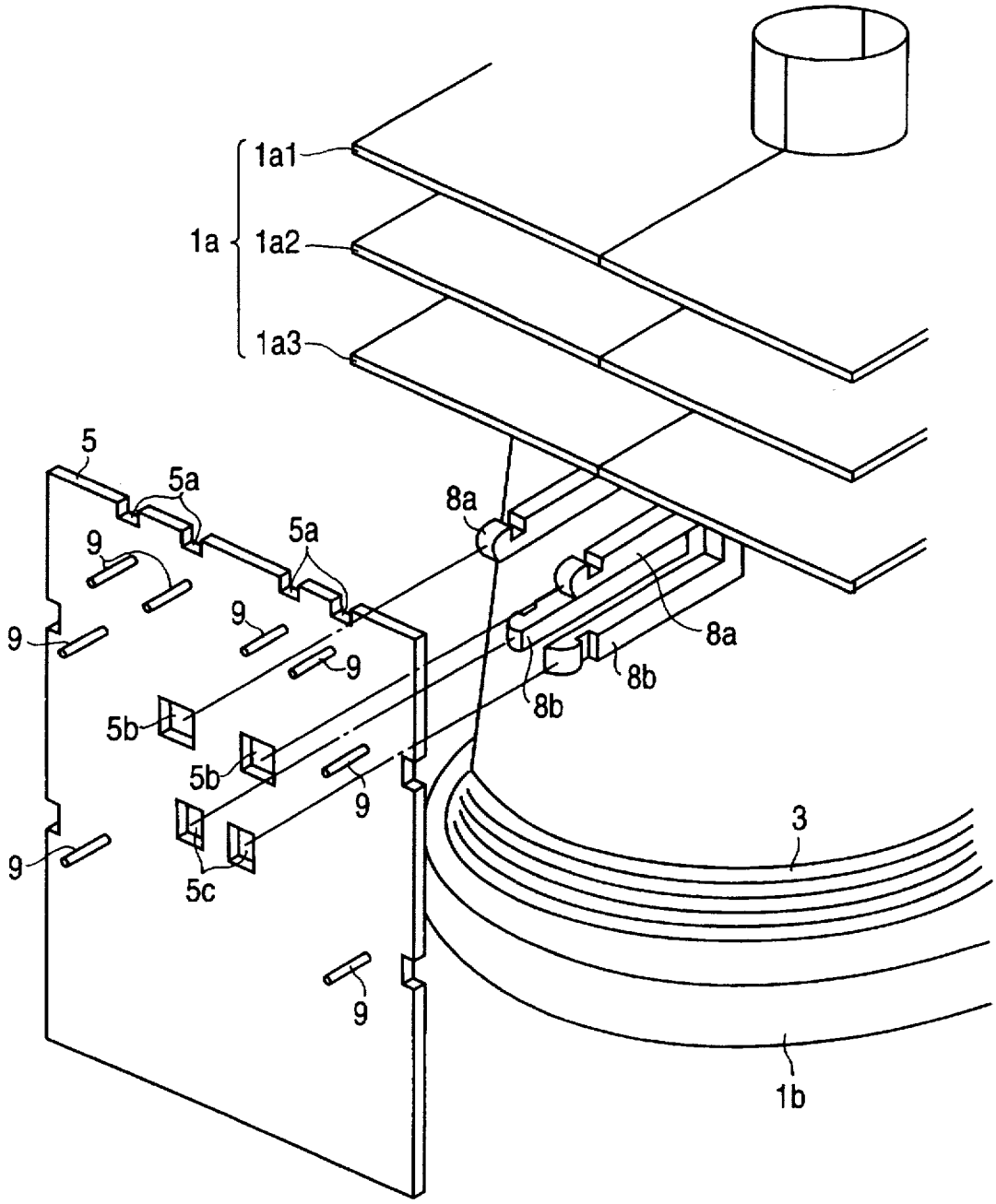
Fig. 3 PRIOR ART
FIG. 3 shows a partial perspective view of the deflection yoke of the prior art shown in FIG. 1.
Figure 4:
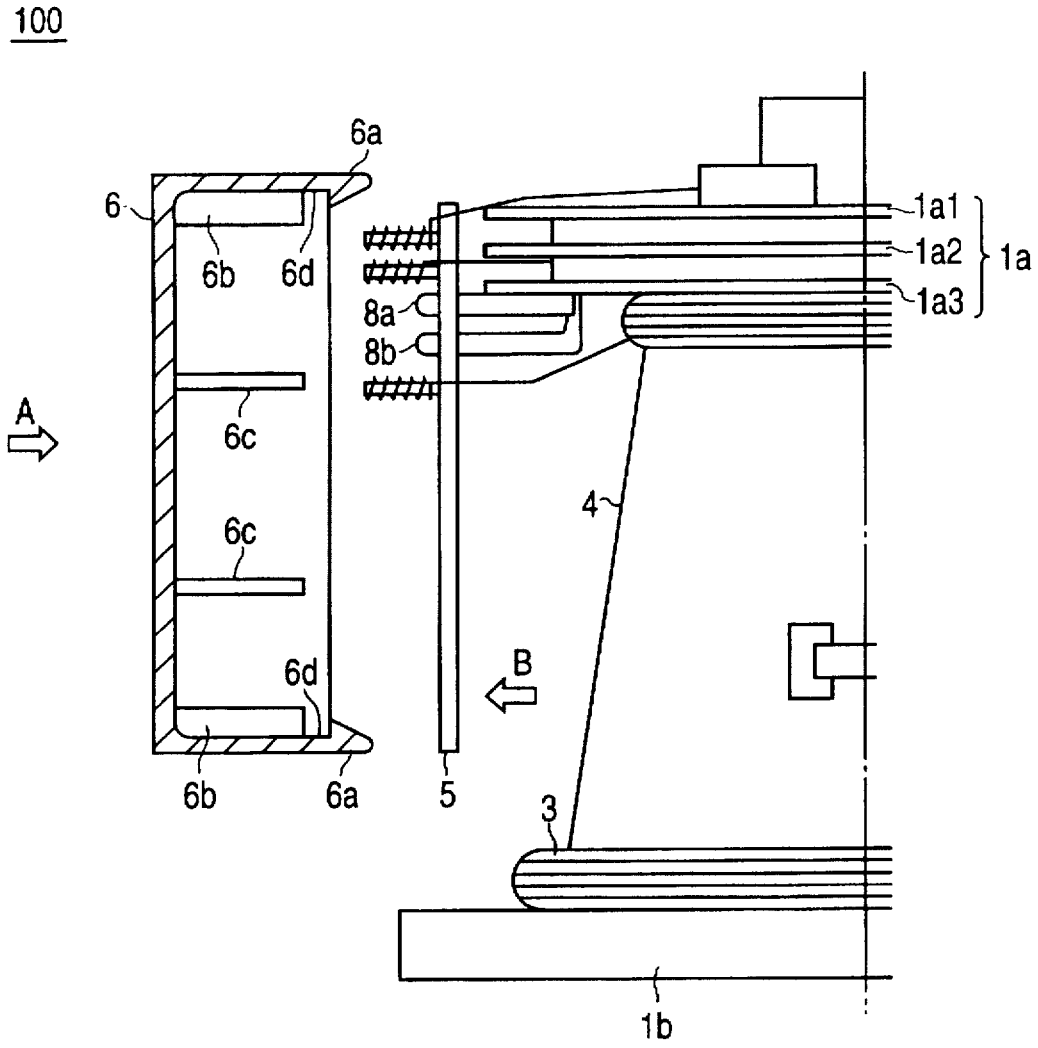
Fig. 4 PRIOR ART
FIG. 4 shows a partial cutaway side view of the deflection yoke shown in FIG. 1 for explaining assembly operations of a protective cover to a flange.
Figure 5:
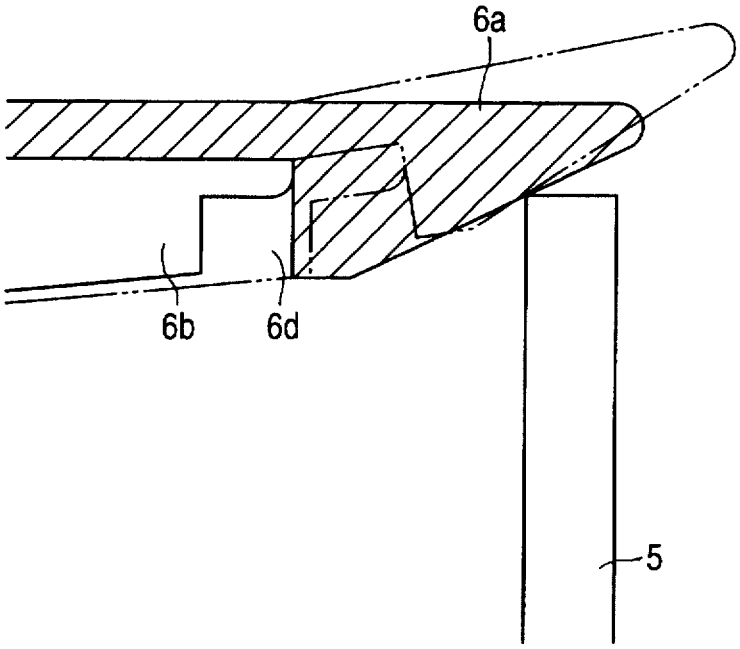
Fig. 5 PRIOR ART
FIG. 5 shows a partial sectional view of the deflection yoke shown in FIG. 1.
Figure 6:
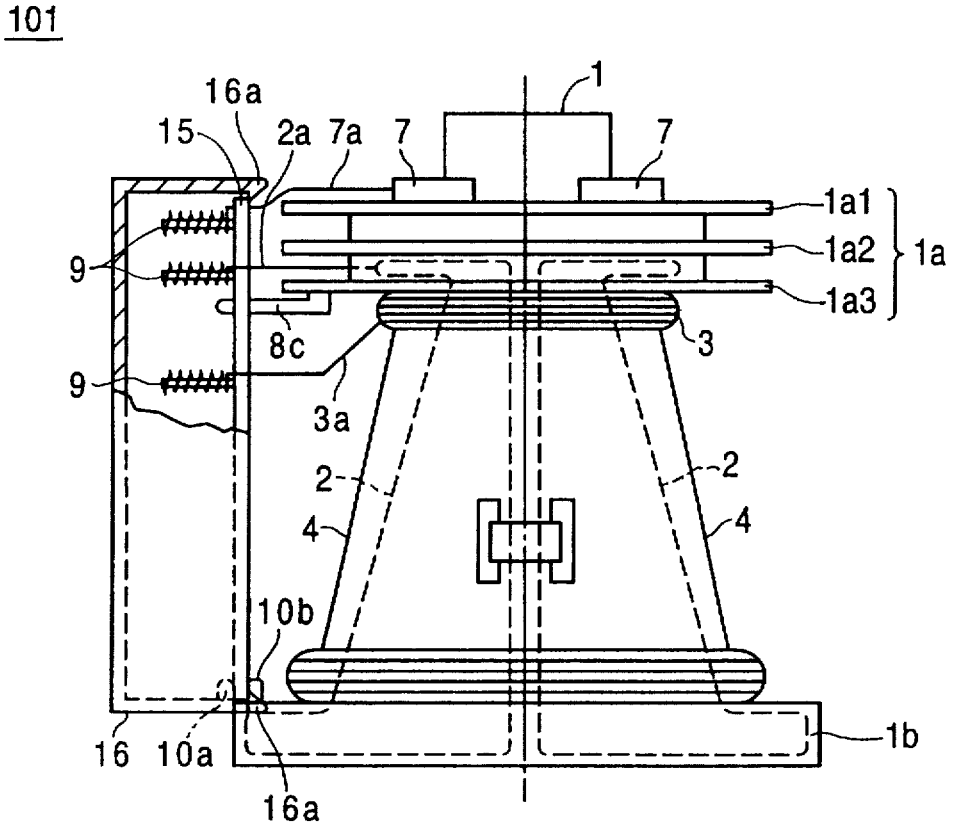
Fig. 6 PRIOR ART
FIG. 6 shows a partial cutaway side view of another deflection yoke of prior art, holding a substrate by both ends thereof.
Figure 7:
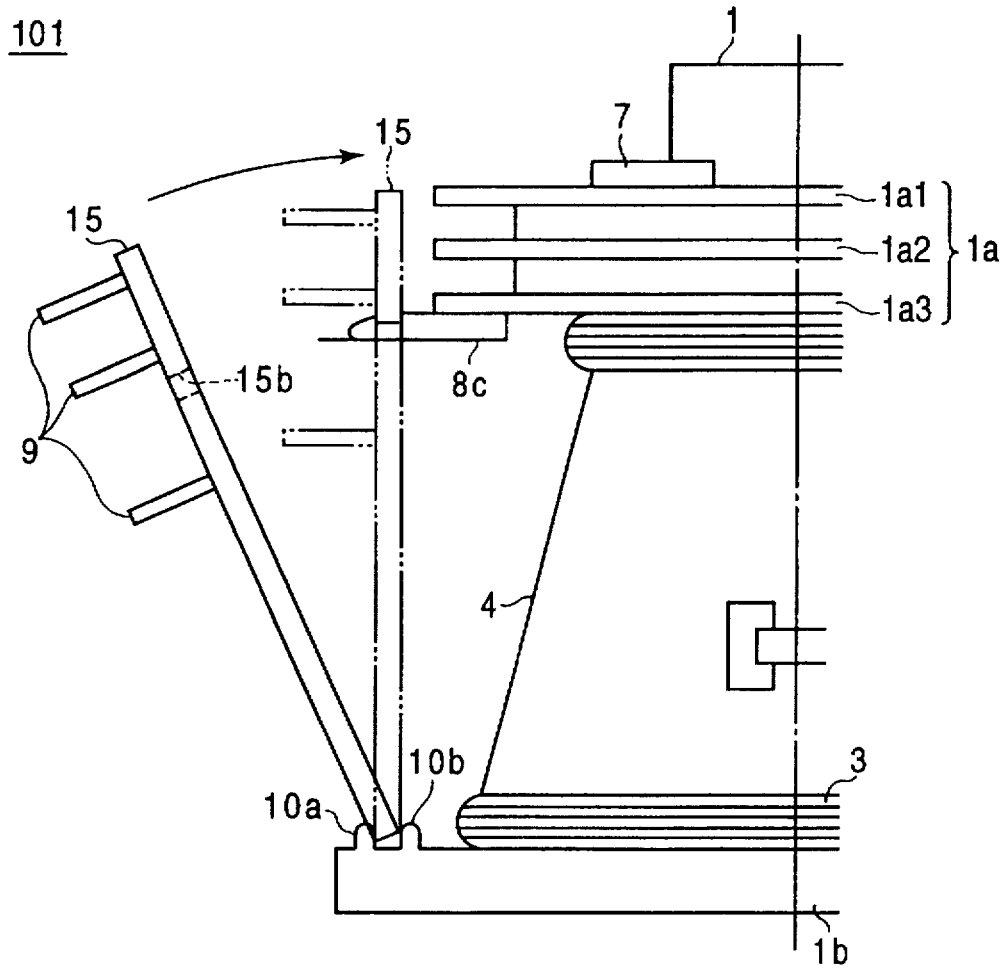
Fig. 7 PRIOR ART
FIG. 7 shows a partial side view of another deflection yoke of prior art.
Figure 8:
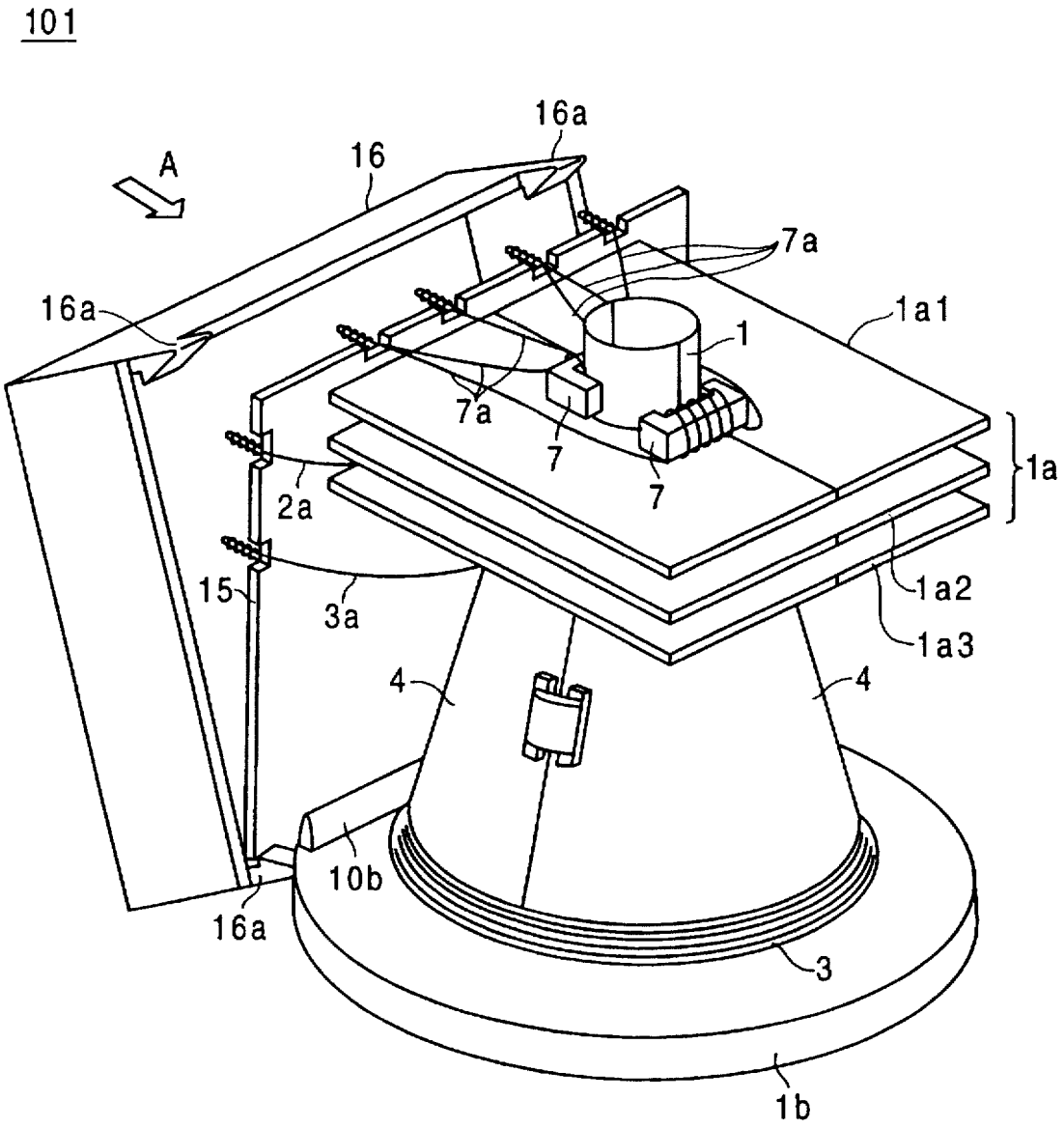
Fig. 8 PRIOR ART
FIG. 8 shows a perspective view of the deflection yoke shown in FIG. 6.
Figure 9:
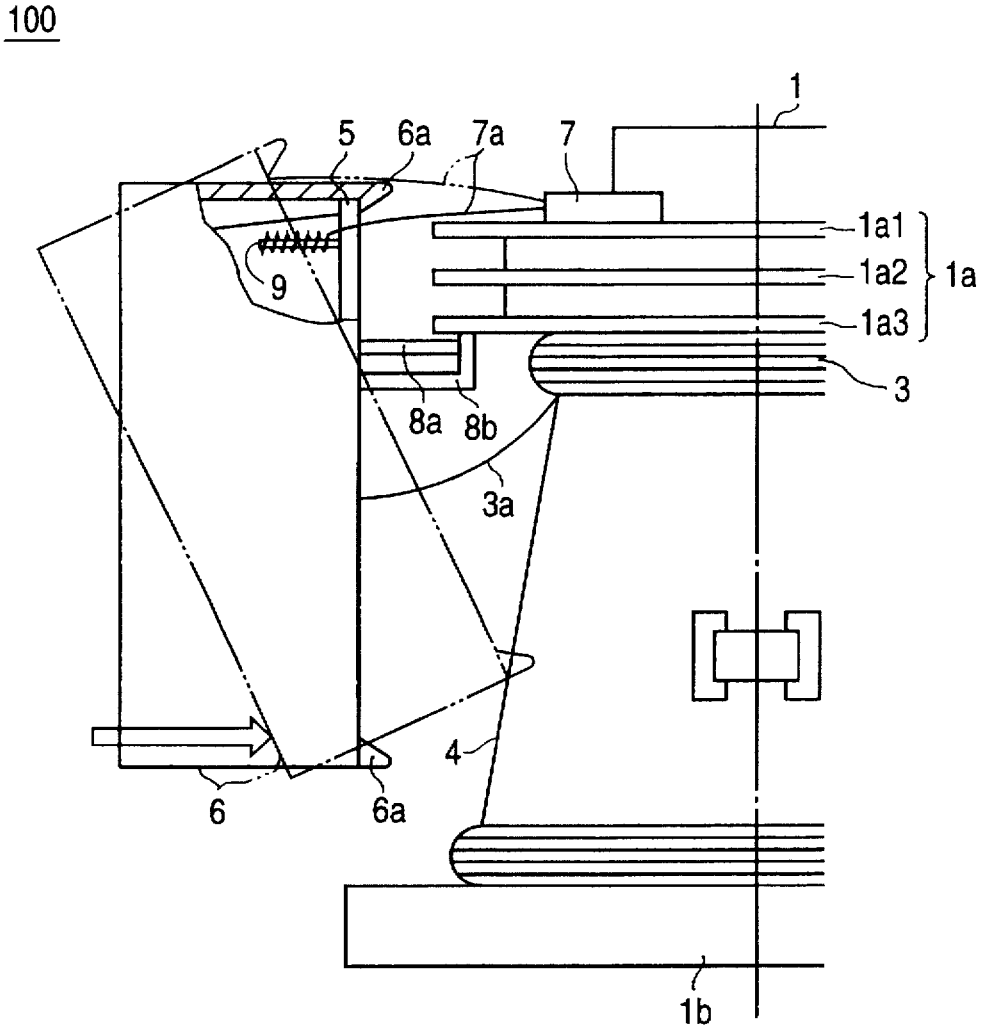
Fig. 9 PRIOR ART
FIG. 9 shows a partial cutaway side view of the deflection yoke shown in FIG. 1.

The substrate 5 is mounted on the separator 1 in the same manner as shown in FIG. 3.

A method for mounting the substrate 5 to the separator 1 will be explained referring to FIGS. 10 and 12.

As shown in FIGS. 10 and 11, hooks 11, 11 are integrally formed with the flange 1*a*1, and ribs 12, 12 are integrally formed with the flange 1*a*1 at both ends thereof. Hooks 13, 13 are integrally formed with the second flange 1*b*, as shown in FIGS. 10 and 12.

The protective cover 26 is formed as an open box. A plurarity of hooks 26*a* is integrally and elastically formed at upper and lower open ends of the protective cover 26 so as to couple with the hooks 11, 13 respectively.

When the flange 1*a*2 or 1*a*3 is positioned higher than the upper edge of the substrate 5, the hooks 11, 11 may be integrally formed with the flange 1*a*2 or 1*a*3.

An assembly operation of the protective cover 26 to the separator 1 will be explained referring to FIG. 10. The protective cover 26 is installed in the separator 1 by pushing in the direction of "A" to couple the hooks 26*a*, 26*a* with the hooks 11, 13, after hooks 26*a*, 11, 13 are properly aligned respectively. Another assembly operation of the protective cover to the separator is to couple the hook 26*a* with one of the hooks 11 or 13 at first, then to clamp the hook 26*a* with another hook 11 or 13. The ribs 12, 12 of the flange 1*a*1 act as a stopper for the hooks 26*a* of the upper edge of the protective cover 26. The hooks 26*a* of the lower edge of the protective cover 26 are restricted by abutting against the wall of the second flange 1*b* or having the hook 13 abutting against the inner surface of the protective cover 26.

When the protective cover 26 is installed in the separator 1, the surfaces of the hooks 11 and 13 are almost in contact with the inner surface of the protective cover 26.

The protection cover 26 is fixed at its position, with respect to the deflection yoke 200 in the directions of "A", "B", "C", "D", still more, in the direction of "E", "F", as shown in FIGS. 10, 11.

After the installation of the protective cover 26 in the deflection yoke 200, the protective cover 26 which is installed in the deflection yoke 200 independently from the substrate 5, covers the substrate 5 as shown in FIG. 10. When a stress is applied to the protection cover 26 in the direction of "A", the stress is directed only to the separator 1, and not to the substrate 5. Thus, there occur no such problems as caused in the prior art. As for the construction of the 1st Embodiment, only one size of the protective cover 26 need be prepared for the various sizes of the substrate 5.

[2nd Embodiment]

Figure 13:
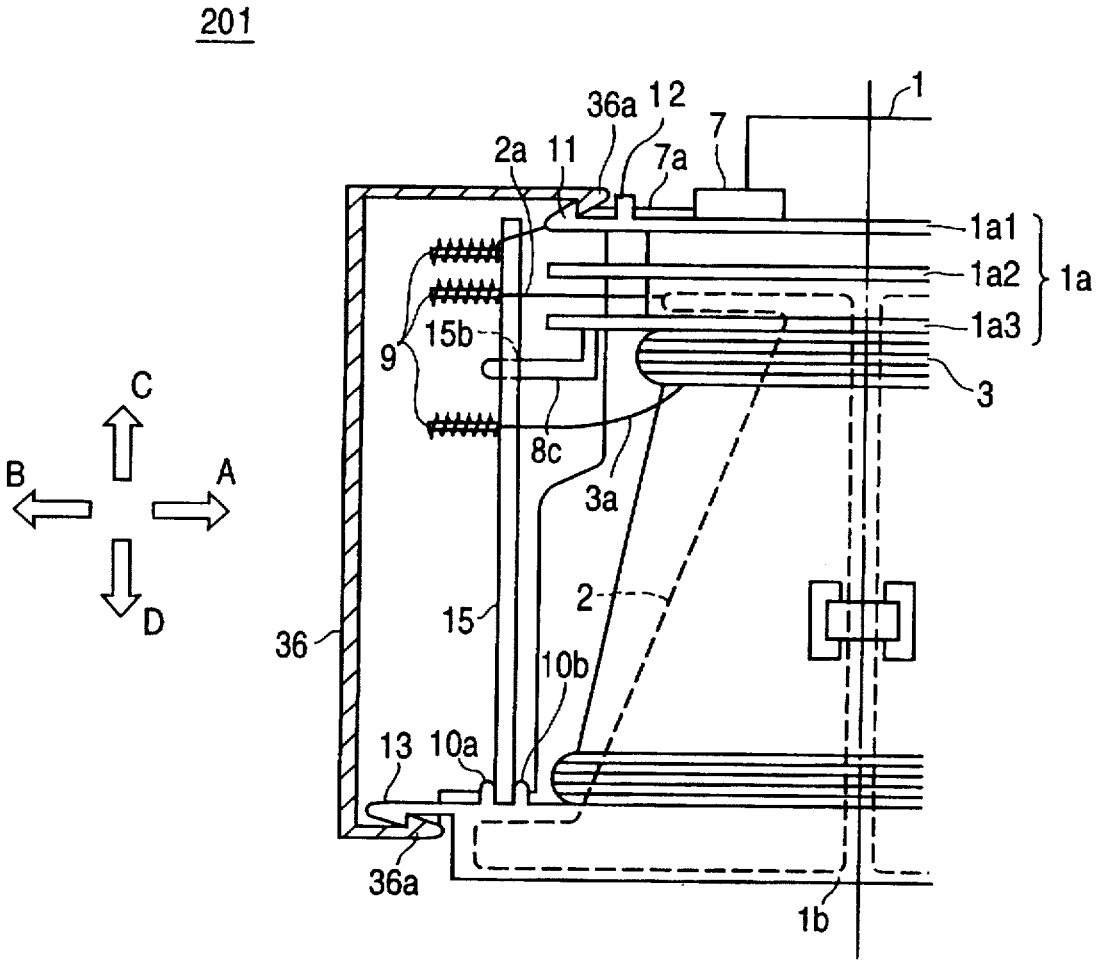
FIG. 13 shows a partial cutaway side view of the left half of the deflection yoke of the present invention in the modified form.

FIG. 13 shows a partial cutaway side view of the left half of the deflection yoke of the present invention in the modified form.

Figure 14:
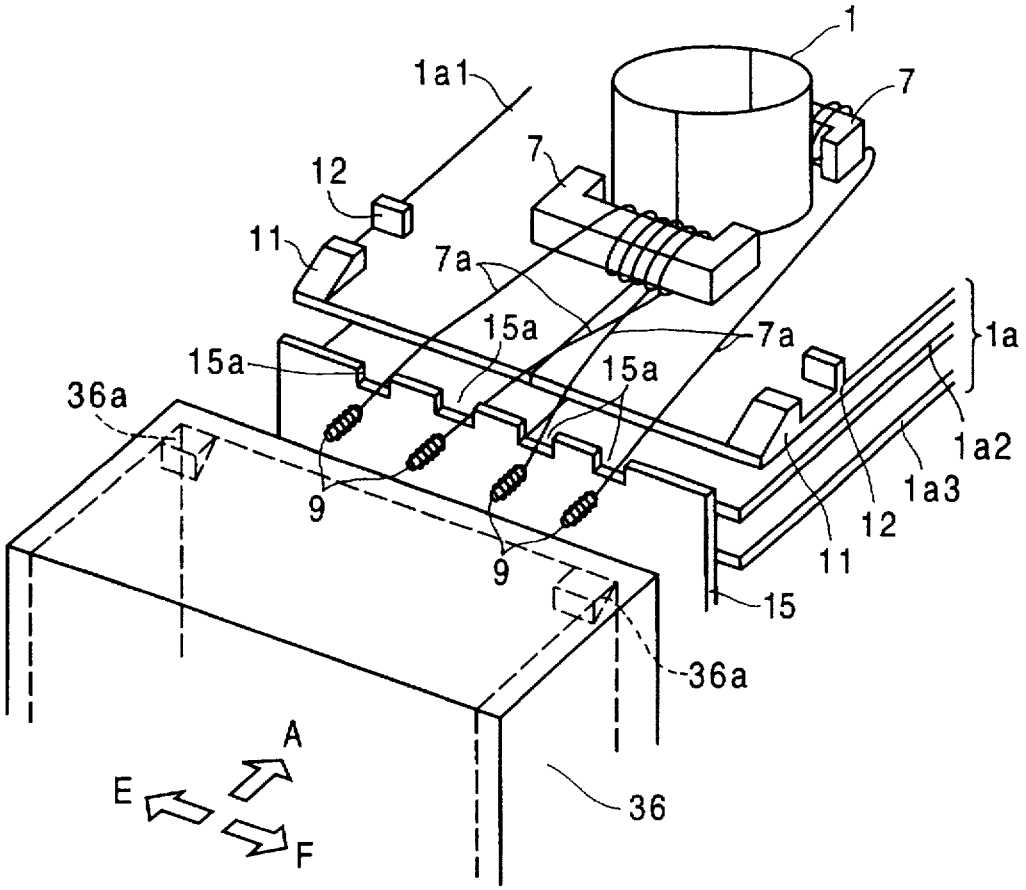
FIG. 14 shows a partial perspective view of the deflection yoke of the present invention in the modified form.

FIG. 14 shows a partial perspective view of the deflection yoke of the present invention in the modified form.

Figure 15:
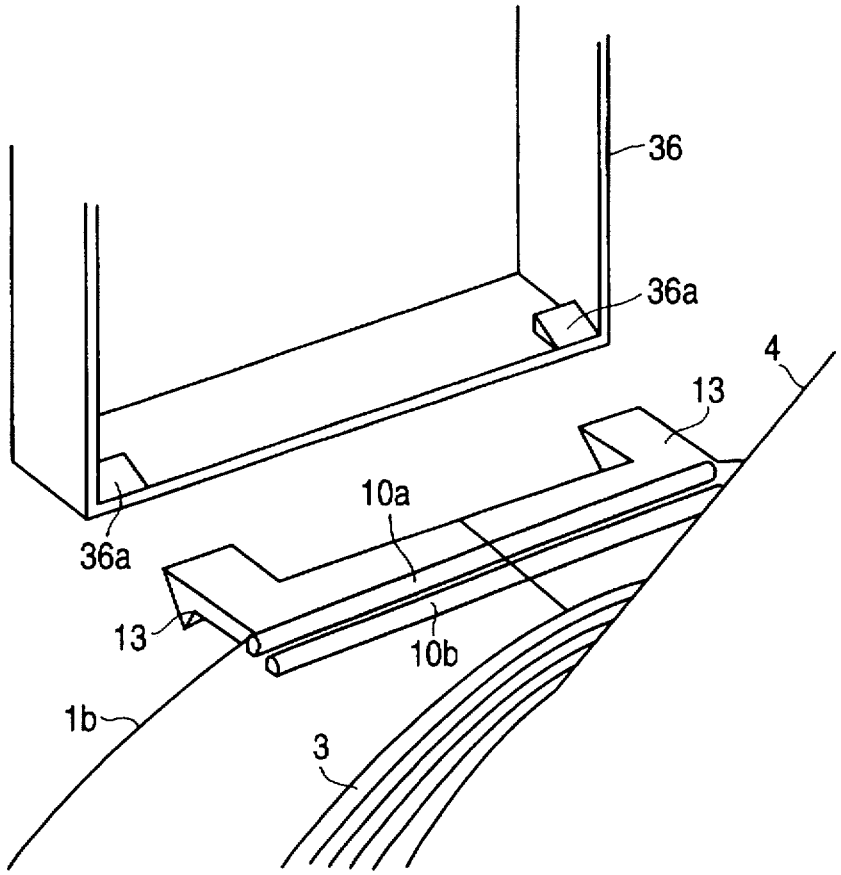
FIG. 15 shows a partial perspective view of the deflection yoke of the present invention in the modified form.

FIG. 15 shows a partial perspective view of the deflection yoke of the present invention in the modified form.

Figure 16A:
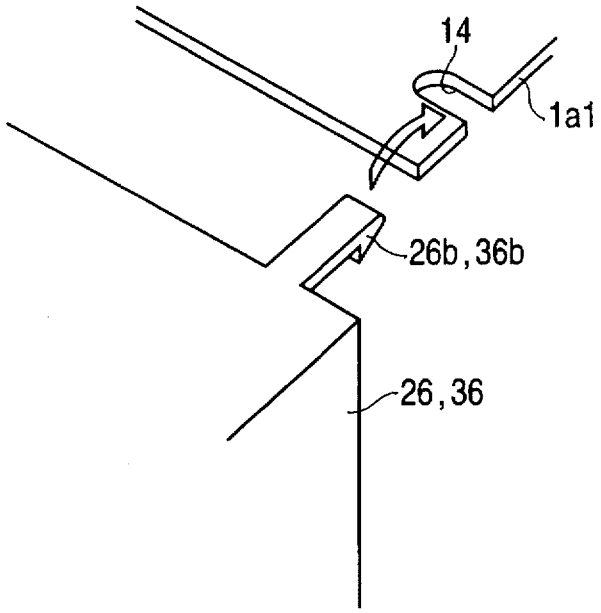
FIG. 16(A) shows a partial perspective view of the deflection yoke of the present invention in the modified form.

FIG. 16(A) shows a partial perspective view of the deflection yoke of the present invention in the modified form.

Figure 16B:
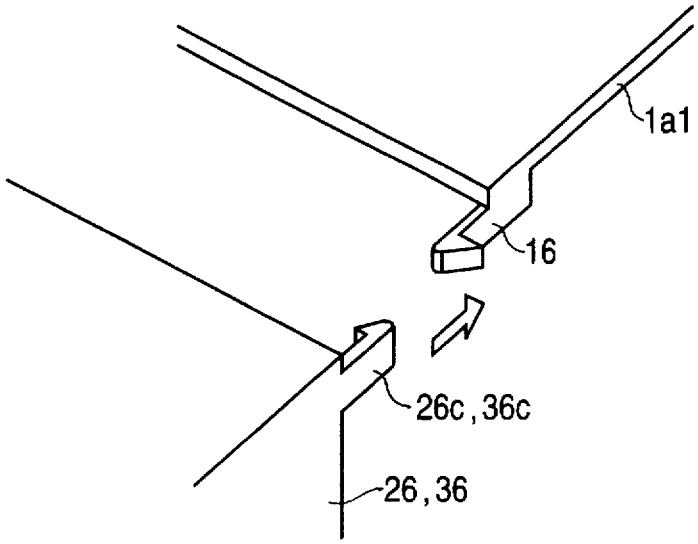
FIG. 16(B) shows a partial perspective view of the deflection yoke of the present invention in the modified form.

FIG. 16(B) shows a partial perspective view of the deflection yoke of the present invention in the modified form.

Figure 17A:
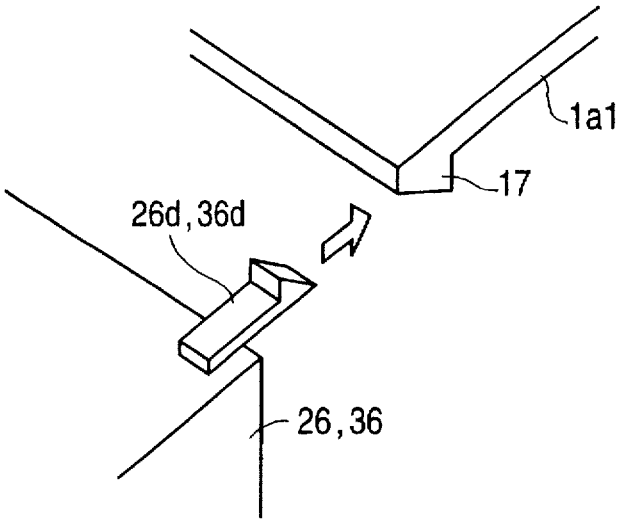
FIG. 17(A) shows a partial perspective view of the deflection yoke of the present invention in the modified form.

FIG. 17(A) shows a partial perspective view of the deflection yoke of the present invention in the modified form.

Figure 17B:
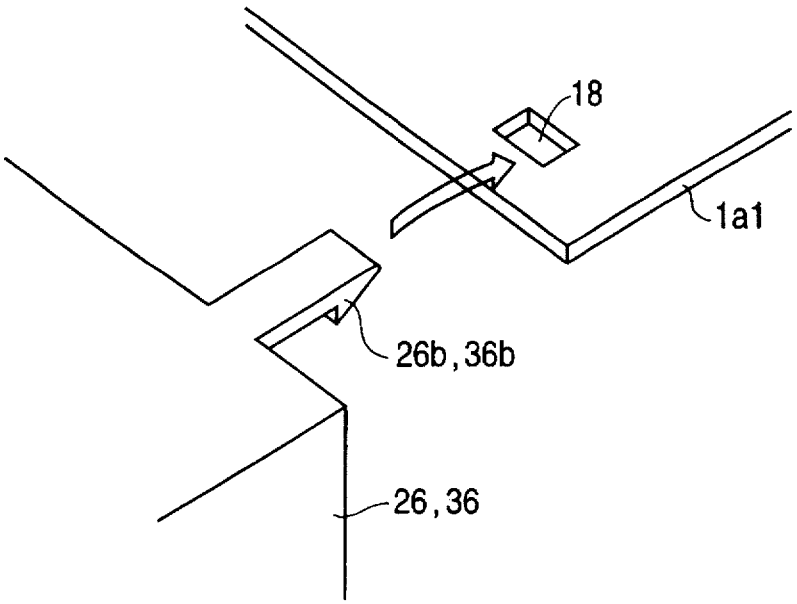
FIG. 17(B) shows a partial perspective view of the deflection yoke of the present invention in the modified form.

FIG. 17(B) shows a partial perspective view of the deflection yoke of the present invention in the modified form.

Figure 18A:
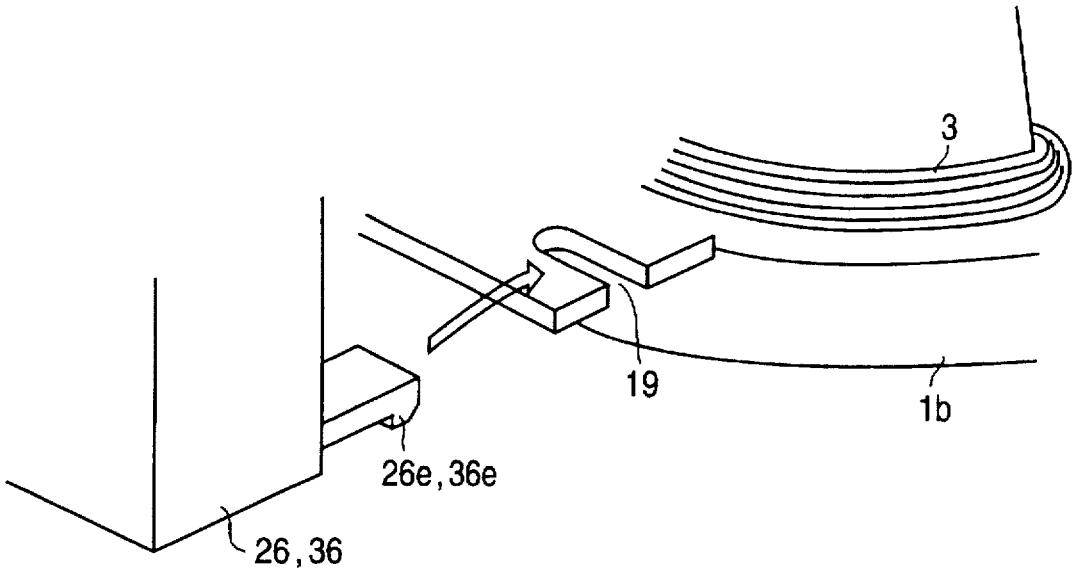
FIG. 18(A) shows a partial perspective view of the deflection yoke of the present invention in the modified form.

FIG. 18(A) shows a partial perspective view of the deflection yoke of the present invention in the modified form.

Figure 18B:
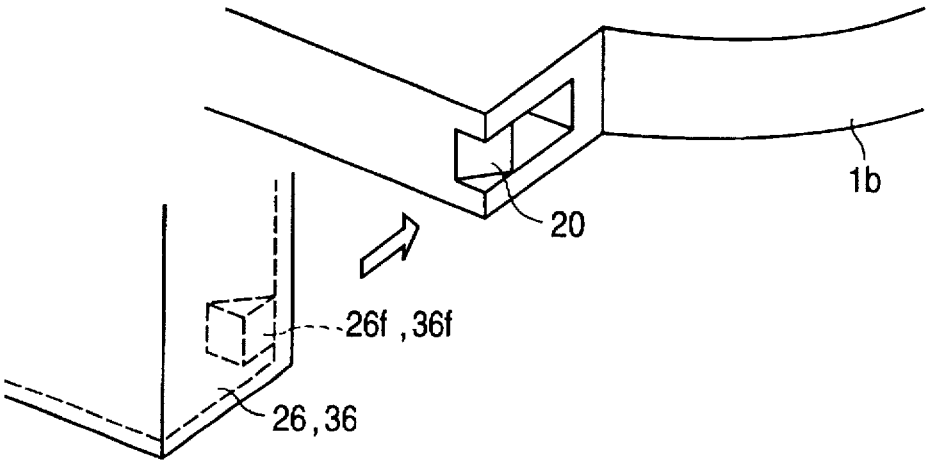
FIG. 18(B) shows a partial perspective view of the deflection yoke of the present invention in the modified form.

FIG. 18(B) shows a partial perspective view of the deflection yoke of the present invention in the modified form.

Figure 19A:
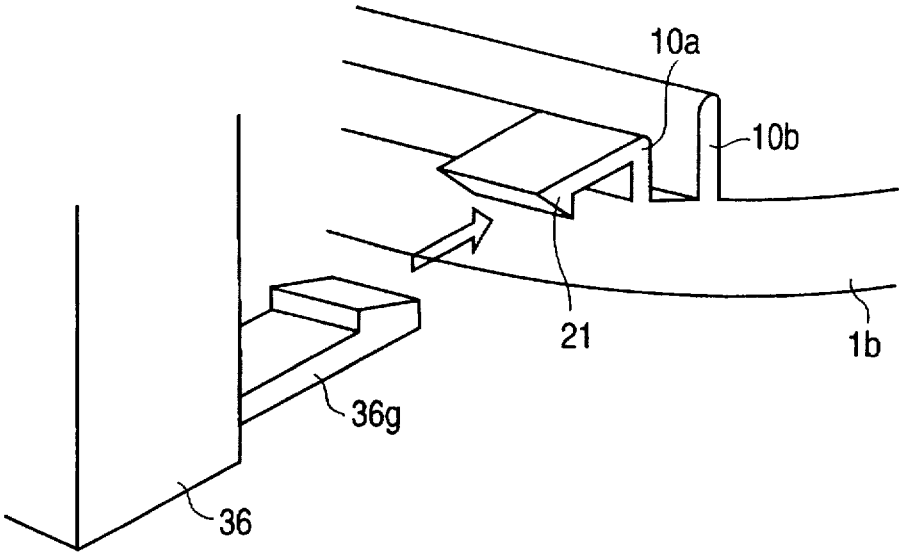
FIG. 19(A) shows a partial perspective view of the deflection yoke of the present invention in the modified form.

FIG. 19(A) shows a partial perspective view of the deflection yoke of the present invention in the modified form.

Figure 19B:
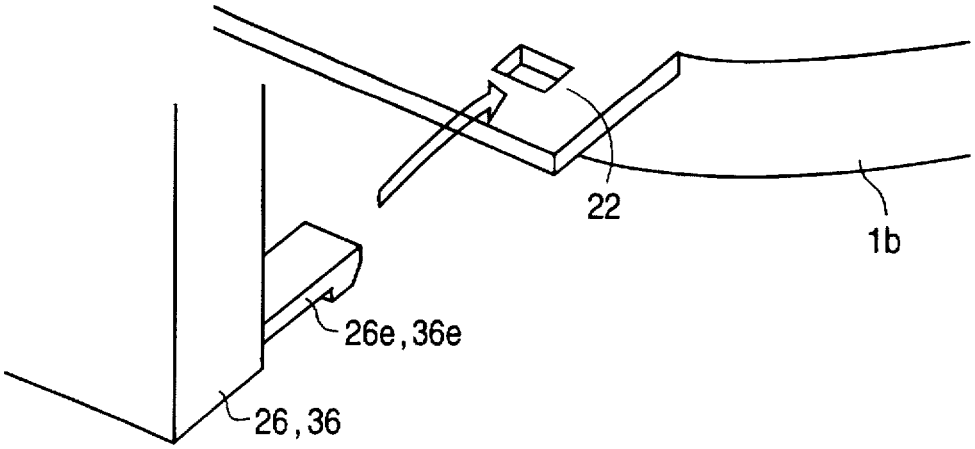
FIG. 19(B) shows a partial perspective view of the deflection yoke of the present invention in the modified form.

FIG. 19(B) shows a partial perspective view of the deflection yoke of the present invention in the modified form.

Figure 20A:
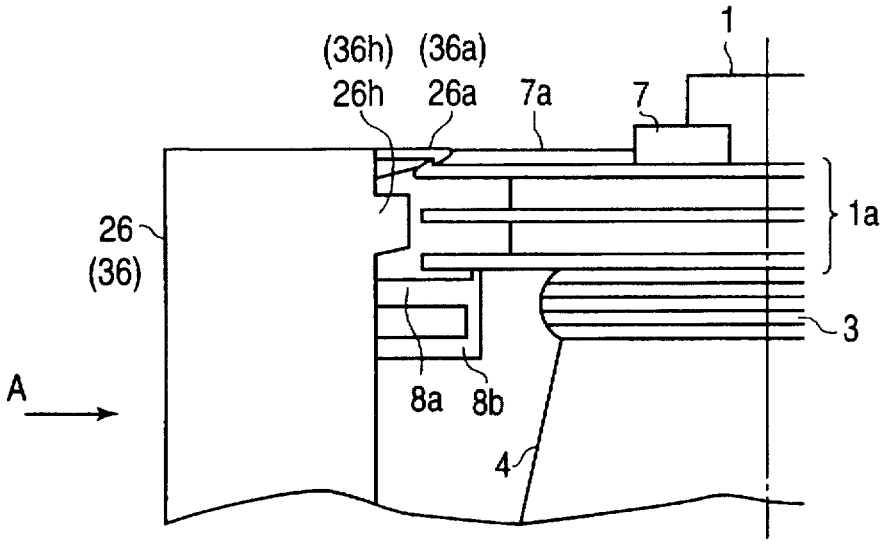
FIG. 20(A) shows a partial side view of the present invention in the modified form.

FIG. 20(A) shows a partial side view of the present invention in the modified form.

Figure 20B:
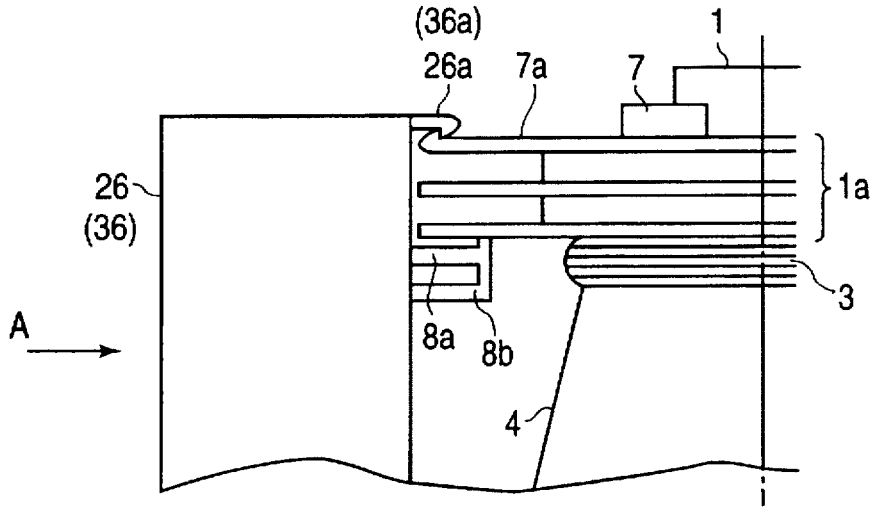
FIG. 20(B) shows a partial side view of the present invention in the modified form.

FIG. 20(B) shows a partial side view of the present invention in the modified form.

A deflection yoke 201 shown in FIG. 13 and the deflection yoke 200 shown in FIG. 10 are different from each other in their substrates and their holding mechanisms. Therefore, explanations of common portions between them will be omitted for simplicity and different portions will be explained in the following.

As shown in FIG. 13, a substrate 15, having a size extended from a first flange 1*a* to a second flange 1*b*, is held at both ends of the separator 1. The hook 8*c* for installing the substrate 15 in the separator 1 is integrally formed with the flange 1*a*3. The plurarity of pins 9 for connecting lead wires are mounted on the substrate 15, wound by the lead wire 7*a* from the compensation coil 7, the lead wire 2*a* from the horizontal deflection coil 2, and the lead wire 3*a* from the vertical deflection coil 3. The pins 9 and the lead wires 7*a*, 2*a*, 3*a* are connected mechanically and electrically by soldering to the substrate 15. After the connection of the lead wires 7*a*, 2*a*, 3*a*, a protective cover 36 is mounted on the separator 1.

A mounting method of the substrate 15 on the separator 1 will be explained referring to FIG. 13. Ribs 10*a*, 10*b* for holding the edge of the substrate 15, are integrally formed with the second flange 1*b*. The edge of the substrate 15 nests in a space formed by the ribs 10*a*, 10*b*.

The substrate 15 has a hole 15*b*, and is coupled with the hook 8*c* of the flange 1*a*3. After nesting of the substrate 15 in the space formed by the ribs 10*a* and 10*b*, the substrate 15 is pushed in the direction of "A", to couple the hook 8*c* with the hole 15*b*.

A connecting method of the lead wire 7*a* to the pin 9 will be explained referring to FIG. 14.

In FIG. 14, the lead wire 7*a* is connected to the pin 9 through a space formed between the protective cover 36 and a notch 15*a* formed on the edge of the substrate 15, and is routed to the pin 9 without any slack. The notch 15*a* is formed on the edge of the substrate 15 near the neck.

A mounting method of the protective cover 36 on the separator 1 is explained referring to FIGS. 13 through 15.

As shown in FIGS. 13 through 15, the hooks 11, 11 are integrally formed with the flange 1*a*1, and the ribs 12, 12 are integrally formed with the flange 1*a*1 at both ends thereof. Hooks 13, 13 are integrally formed with the second flange 1*b*.

The protective cover 36 is formed into an open box shape. A plurarity of hooks 36*a* is integrally and elastically formed at upper and lower open ends of the protective cover 36 so as to couple with the hooks 11, 13 respectively.

When the flange 1*a*2 or 1*a*3 is positioned higher than the upper edge of the substrate 15, the hooks 11, 11 may be integrally formed with the flange 1*a*2 or 1*a*3.

An assembly operation of the protective cover 36 to the separator 1 will be explained referring to FIGS. 13 and 14. The protective cover 36 is installed in the separator 1 by pushing in the direction of "A" to couple the hooks 36*a*, 36*a* with the hooks 11, 13, after hooks 36*a*, 11, 13 are properly aligned. Another assembly operation of the protective cover to the separator 1 is to couple the hook 36*a* with one of the hooks 11 or 13 at first, then clamping another hook 36*a* with another hook 11 or 13. The ribs 12, 12 of the flange 1*a*1 act as a stopper for the hooks 36*a* of the upper edge of the protective cover 36. The hooks 36*a* of the lower edge of the protective cover 36 are restricted by abutting against the wall of the second flange 1*b* or having the hook 13 abutting against the inner surface of the protective cover 36.

When the protective cover 36 is installed in the separator 1, the surfaces of the hooks 11 and 13 are almost in contact with the inner surface of the protective cover 36.

The movement of the protection cover 36 is restricted, with respect to the deflection yoke 201, in the directions of "A", "B", "C", "D", still more, restricted in the direction of "E", "F", as shown in FIGS. 13, 14.

After installation of the protective cover 36 in the deflection yoke 201, the protective cover 36 which is installed in the deflection yoke 201 independently from the substrate 15, covers the substrate 15 as shown in FIG. 13. When a stress is applied to the protection cover 36 in the direction of "A", the stress is directed only to the separator 1, and not to the substrate 15. Thus, there occur no such problems as caused in the prior art. In the 2nd Embodiment, only one size of the protective cover 36 need be prepared for various sizes of the substrate 15.

In FIGS. 10 and 13 of the 1st and 2nd Embodiments, the protective cover 26 (36) is installed by coupling the hooks 11 (13) of the separator 1 with the hooks 26*a* (36*a*) of the protective cover 26 (36). Other coupling devices may be applied as shown in the following.

FIGS. 16(A), 16(B), 17(A) and 17(B) show various coupling methods for coupling the upper part of the protective cover 26 (36) to the flange 1*a*1.

In FIG. 16(A), a hook 26*b* (36*b*) oriented downward is formed integrally and elastically with the protective cover 26 (36), and a notch 14 is formed on the flange 1*a*1, for coupling the hook 26*b* (36*b*) with the notch 14.

In FIG. 16(B), a hook 26*c* (36*c*) oriented inward is formed integrally and elastically with the protective cover 26 (36), and a hook 16 oriented outward is formed integrally and elastically with the flange 1*a*1, for coupling the hook 26*c* (36*c*) with the hook 16.

In FIG. 17(A), a hook 26*d* (36*d*) oriented upward is formed integrally and elastically with the upper side of the protective cover 26 (36), and a hook 17 oriented downward is formed integrally with the flange 1*a*1, for coupling the hook 26*d* (36*d*) with the hook 17.

In FIG. 17(B), a hook 26*b* (36*b*) oriented downward is formed integrally and elastically with the protective cover 26 (36), and a hole 18 is formed on the flange 1*a*1, for coupling the hook 26*b* (36*b*) with the hole 18.

FIGS. 18(A), 18(B), 19(A) and 19(B) show other coupling methods for coupling the lower part of the protective cover 26 (36) to the second flange 1*b*.

In FIG. 18(A), a hook 26*e* (36*e*) oriented downward is formed integrally and elastically with the protective cover 26 (36), and a notch 19 is formed on the second flange 1*b*, for coupling the hook 26*e* (36*e*) with the notch 19.

In FIG. 18(B), a hook 26*f* (36*f*) oriented inward is formed integrally and elastically with the protective cover 26 (36), and a hook 20 is integrally and elastically formed on the inside of the second flange 1*b*, for coupling the hook 26*f* (36*f*) with the hook 20.

In FIG. 19(A), a hook 36*g* oriented upward is formed integrally and elastically with the lower side of the protective cover 36, and a hook 21 oriented downward is integrally formed with a rib 10*a* of the second flange 1*b*, for coupling the hook 36*g* with the hook 21.

In FIG. 19(B), a configuration similar to the one shown in FIG. 18(A), a hook 26*e* (36*e*) oriented downward is formed integrally and elastically with the protective cover 26 (36), and a hole 22 is formed on the second flange 1*b*, for coupling the hook 26*e* (36*e*) with the hole 22.

As shown in FIGS. 10 and 13, the rib 12 is formed on the flange 1*a*1 for restricting the movement of the protective cover 26 (36) in the direction of "A", however, other devices may be provided for the same.

As shown in FIG. 20(A), a projection 26*h* (36*h*) is integrally formed with the protective cover 26 (36) adjacent to or in contact with the first flange 1*a* for restricting the protective cover 26 (36) to move in the direction of "A".

As shown in FIG. 20(B), the vertical edge of the protective cover 26 (36) is formed to be adjacent to or in contact with the first flange 1*a* for restricting the movement of the protective cover 26 (36) in the direction of

[3rd Embodiment]

Figure 21:
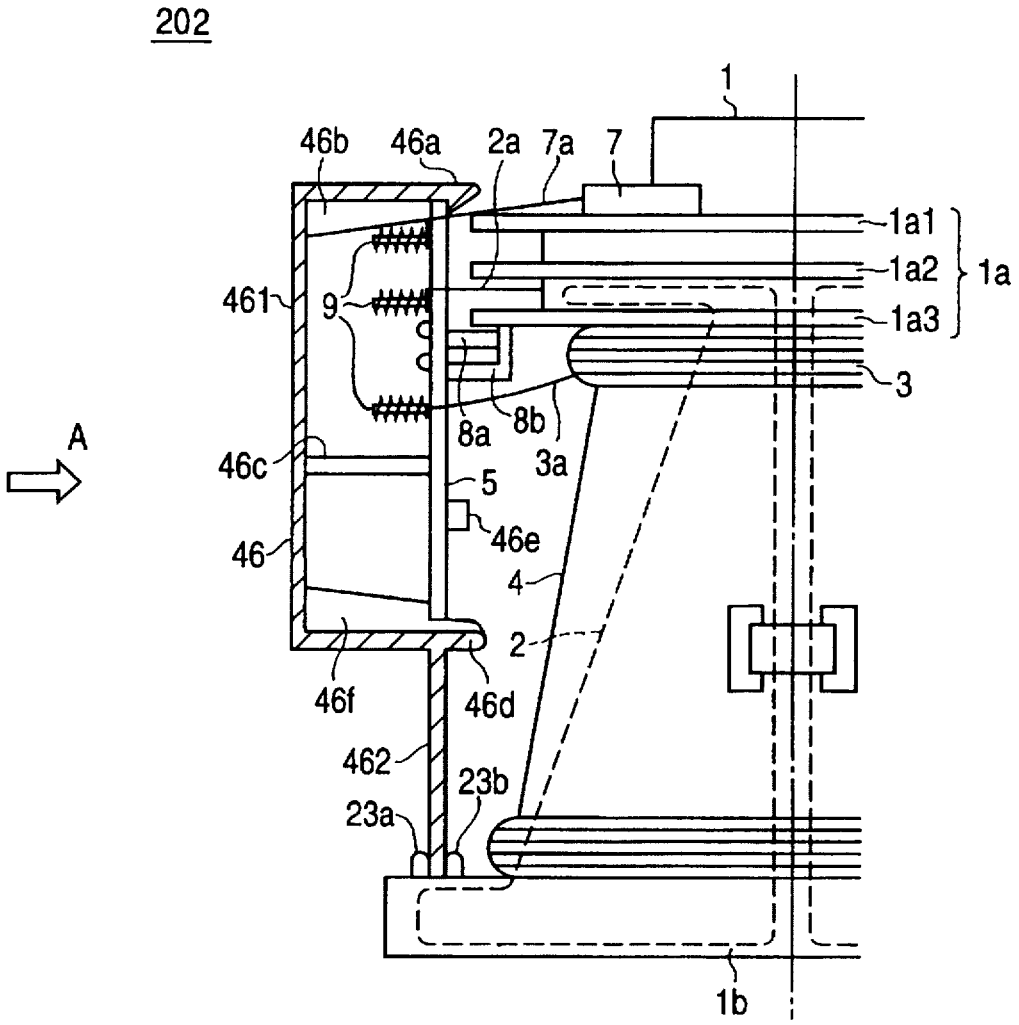
FIG. 21 shows a partial cutaway side view of the deflection yoke of the present invention in another modified form.

FIG. 21 shows a partial cutaway side view of the deflection yoke of the present invention in another modified form.

Figure 22:
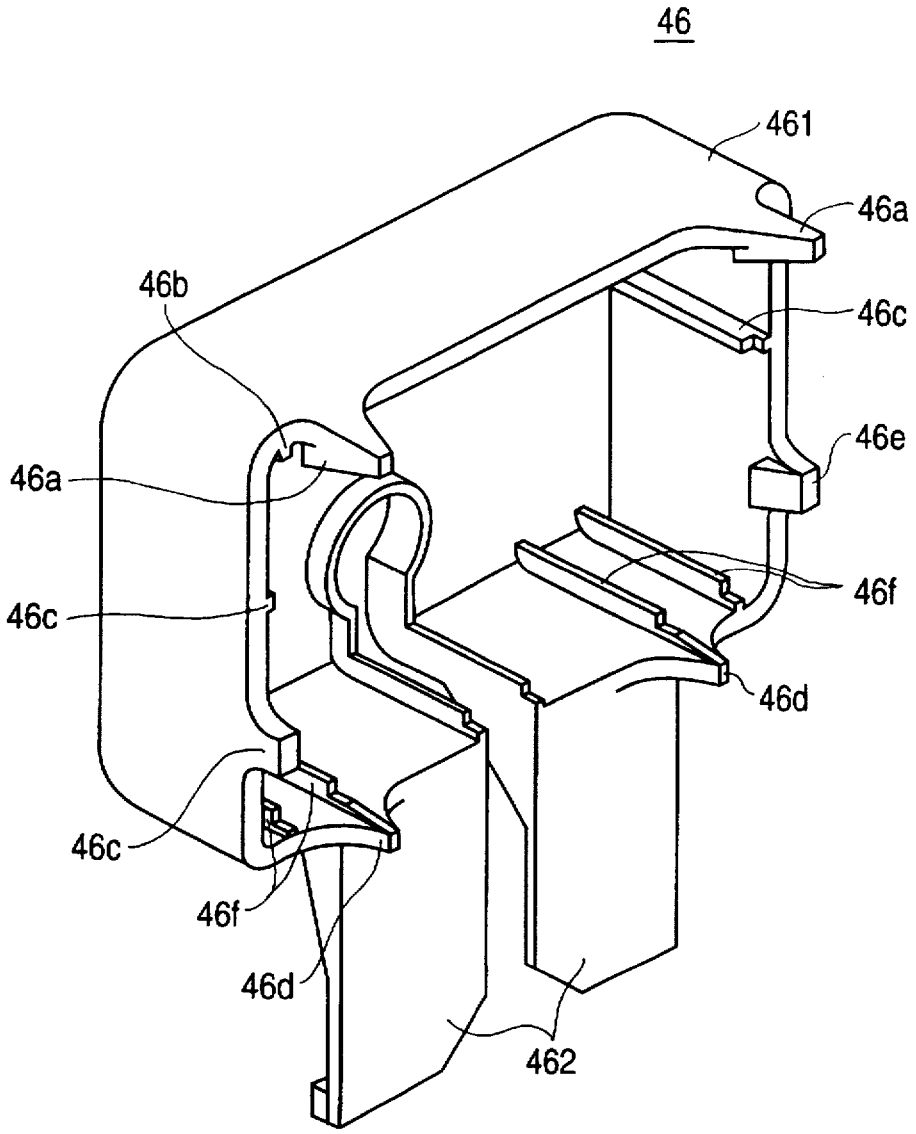
FIG. 22 shows a perspective view of a protective cover of the deflection yoke of the present invention.

FIG. 22 shows a perspective view of a protective cover of the deflection yoke of the present invention.

Figure 23:
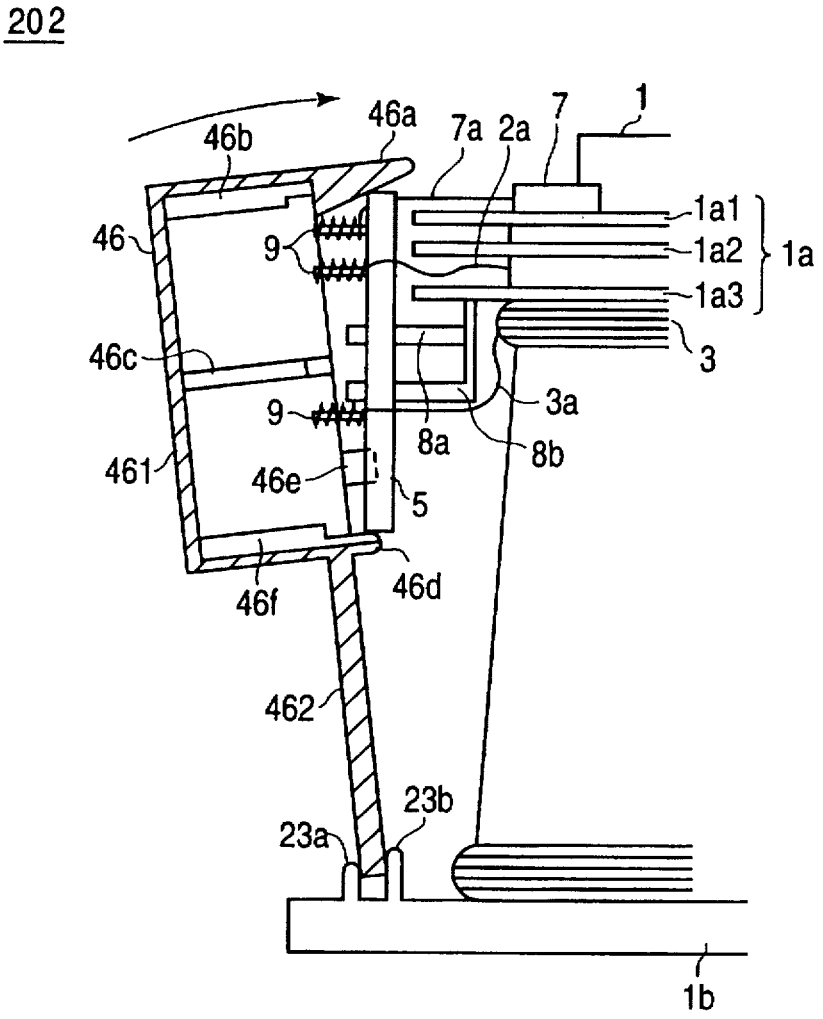
FIG. 23 shows a partial cutaway side view of the deflection yoke of the present invention in the modified form shown in FIG. 21.

FIG. 23 shows a partial cutaway side view of the deflection yoke of the present invention in the modified form shown in FIG. 21.

Figure 24A:
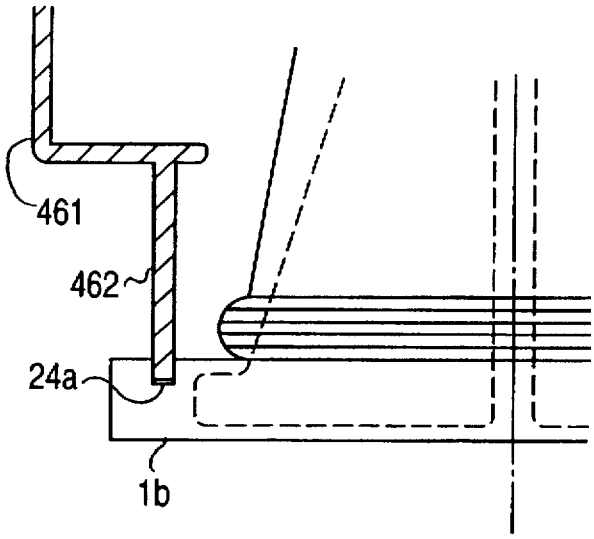
FIG. 24(A) shows a partial side view of the deflection yoke of the present invention.

FIG. 24(A) shows a partial side view of the deflection yoke of the present invention.

Figure 24B:
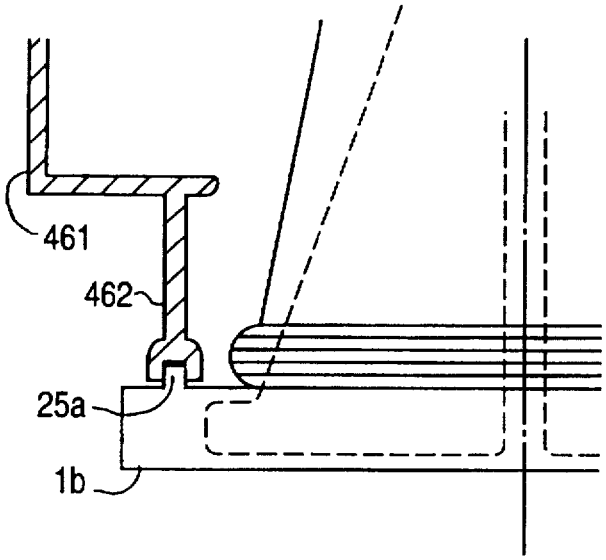
FIG. 24(B) shows a partial side view of the deflection yoke of the present invention.

FIG. 24(B) shows a partial side view of the deflection yoke of the present invention.

Figure 25:
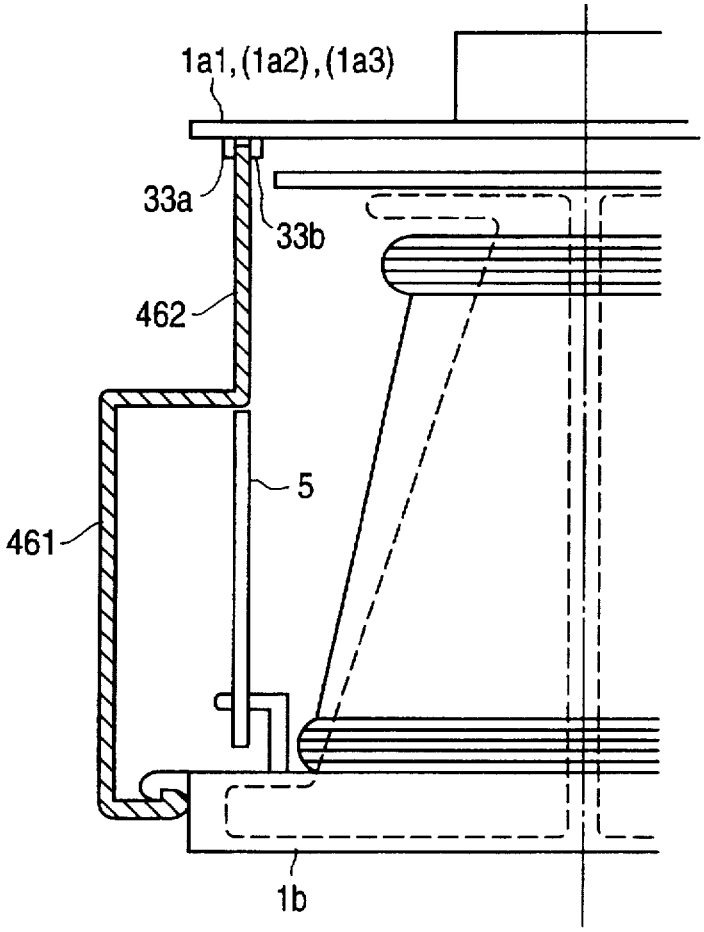
FIG. 25 shows a partial side view of the deflection yoke of the present invention.

FIG. 25 shows a partial side view of the deflection yoke of the present invention.

Figure 26:
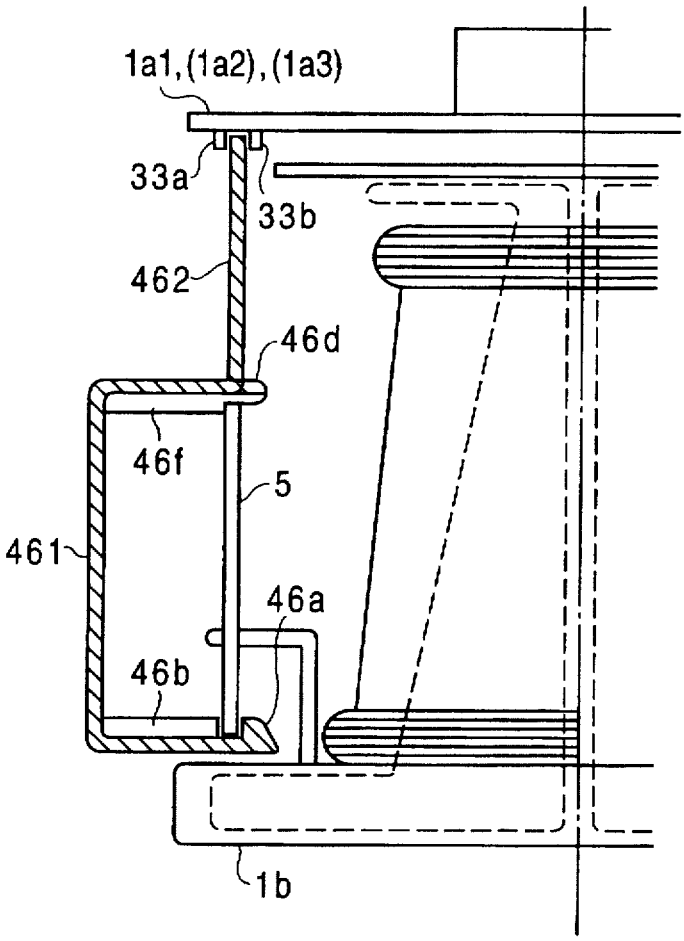
FIG. 26 shows a partial side view of the deflection yoke of the present invention.

FIG. 26 shows a partial side view of the deflection yoke of the present invention.

As described for the 1st and 2nd embodiments, the protective cover 26 (36) is supported by both the first flange 1*a* and second flange 1*b*, covering the substrate 5 (15) but being supported independently therefrom.

When a protective cover is not supported by both ends thereof by some means, the protective cover is compelled to be supported by the first flange or the second flange. Solutions to this problem will be shown hereinafter.

FIG. 21 shows a deflection yoke 202 of cantilever structure, and a protective cover 46 is held by the second flange 1*b*.

The structure and supporting mechanism of a protective cover 46 are different from those of the deflection yoke 200 shown in FIG. 10.

As shown in FIGS. 21 and 22, the protective cover 46 is comprised of a box 461 and a leg 462. A plurarity of hooks 46*a* is integrally and elastically formed on the upper wall of the box 461. A plurarity of ribs 46*b* is formed on the inner and upper walls of and integrally with the box 461. A plurarity of ribs 46*f* is formed on the inner and lower walls of and integrally with the box 461. Two ribs 46*c* are respectively formed on the side walls of the box 461, extending horizontally between top and bottom walls thereof. A plurarity of projections 46*d* is formed on the bottom wall of and integrally with the box 461, pairing with the hooks 46*a*. A hook 46*e* is elastically formed inside of the inner side wall of, and integrally with the box 461, below the rib 46*c*.

Ribs 23*a*, 23*b* for holding the lower end of the leg 462 are integrally formed with the second flange 1*b*. The leg 462 nests in a space formed by the ribs 23*a*, 23*b*.

The separator 1 shown in FIG. 13 may be applied in this case, because the ribs 23*a*, 23*b* are the same as the ribs 10*a*, 10*b*.

A mounting method of the protective cover 46 on the separator 1 will be explained referring to FIG. 23. Firstly the leg 462 of the protective cover 46 nests in the space formed by the ribs 23*a*, 23*b*. Then, the protective cover 46 is pushed in the direction of the arrow. The upper edge of the substrate 5 nests in the space between the hook 46*a* and the rib 46*b*. The side edge of the substrate 5 is held by the hook 46*e*. The lower edge of the substrate 5 contacts the rib 46*f* and the projection 46*d*. The substrate 5 is almost in contact with the ribs 46*f* and 46*c*. Thus, the box 461 of the protective cover 46 holds the substrate 5 at many positions thereof.

Another mounting method of the protective cover 46 on the separator 1 is shown in FIG. 26. The leg 462 of the protective cover 46 nests in the space formed by ribs 33*a* and 33*b*, which are formed on the first flange 1*a*. The lower edge of the substrate 5 nests in the space formed between the hook 46*a* and the rib 46*b*. Other structures are the same to the previous case shown in FIG. 23.

As shown in the foregoing, the deflection yoke 202 of the 3rd embodiment reduces the applied stress to the substrate 5 by distributing the stress to many contact portions, such as the hooks 46*a*, 46*e*, the projection 46*d*, the ribs 46*b*, 46*c*, 46*f* and the leg 462.

A stress will concentrate in an area of the substrate 5 in the installation process of the protective cover 46 in the deflection yoke 202, unless a countermeasure is provided in the construction of the deflection yoke 202.

To avoid the problem mentioned in the above, all of the contacting portions, such as the hooks 46*a*, 46*e*, the projection 46*d*, with the substrate 5, are designed to contact the substrate 5 simultaneously, when the protective cover 46 is installed in the deflection yoke 202. Lengths of the hooks 46*a*, 46*e*, and of the projection 46*d* are respectively determined so as to touch the substrate 5 simultaneously, as shown in FIG. 23. Thus, there occurs no cut of the lead wire 7*a* and no break of the substrate 5. Accordingly, an installing operation of the protective cover 46 will be performed easily.

The substrate 5 is made free from the stress caused by the installation of the protective cover 46 in that a projection 26*h* (36*h*) is integrally formed on the protective cover 46 for contacting the flange 1, as shown in FIG. 20(A), or in that the protective cover 26 (36) is placed adjacent to or in contact with the first flange 1*a*, as shown in FIG. 20(B).

The holding structure of the leg 462 is not limited to the ribs 23*a*, 23*b*, and there may be another structure, such as a ditch 24*a* shown in FIG. 24(A), or a ridge 25*a* shown in FIG. 24(B).

When the substrate 5 is held by the flange 1*b*, holding structures of the protective cover 46 may be formed on the flanges 1*a* and 1*b*, as shown in FIG. 25.

Although the 3rd embodiment is explained utilizing the cantilever structure of the deflection yoke, it may be applied to the deflection yoke which holds the substrate at both ends thereof.

The substrate 5 (15) provided with electronic circuit is protected by the protective cover 26 (36, 46), which is described in the 1st through 3rd embodiments. A substrate provided with other elements such as a pin for connecting a lead wire may be protected by the protective cover 26 (36, 46) in the same manner as described in the 1st through 3rd embodiments. First through 3rd embodiments can be applied to the saddle type deflection yoke as well as to a saddle-toroidal type deflection yoke.

The protective cover of the present invention may be widely applied to the protection of elements attached to the deflection yoke.

The above embodiments of the present invention have advantages as follows.

The deflection yoke of the present invention has the protective cover for covering the substrate. The protective cover is held to the separator by a first coupling device formed on the first flange and a second coupling device formed on the second flange, or held to the separator by one of the first and second coupling devices, and by a third coupling device formed on the substrate, which is provided at an opposite position of the first or second supporting device. All of or most of the stress applied toward the protective cover is directed to the separator. Accordingly, the substrate is almost not subjected to the stress. Thus, the protective cover doesn't fail to cover the substrate, the substrate doesn't break, the hooks for mounting the substrate to the separator dont break, the lead wire connected to the substrate isn't cut, and the protective cover is installed easily in the separator.

What is claimed is:

1. A deflection yoke comprising:

separator means having a funnel shape and having a large brim and a small brim, said large brim being adapted to be located adjacent the front end of a cathode ray tube when the deflection yoke is mounted thereon and said small brim being adapted to be located adjacent the rear end of said cathode ray tube;

a first flange formed on said small brim;

a second flange formed on said large brim;

a substrate held by at least one of said first and second flanges;

a protective cover for protecting said substrate, said protective cover having a first end adapted to be mounted on said small brim and a second end adapted to be mounted on said large brim;

first coupling means for coupling said first flange to said protective cover at said first end; and second coupling means for coupling said second flange to said protective cover at said second end.

2. A deflection yoke comprising;

separator means having a funnel shape and having a large brim and a small brim, said large brim being adapted to be located adjacent the front end of a cathode ray tube when the deflection yoke is mounted thereon, and said small brim being adapted to be located adjacent the rear end of said cathode ray tube;

a first flange formed on said small brim;

a second flange formed on said large brim;

a substrate held by at least one of said first and second flanges; and a protective cover for protecting said substrate, wherein said protective cover has a first end provided with one of first and second coupling means for coupling said protective cover to one of said first and second flanges, said protective cover further having a second end opposite to said first end, said second end being provided with third coupling means for coupling said second end to said substrate.

3. A deflection yoke claimed in claim 1, wherein said protective cover has a side open toward said substrate and an edge of said side is located close to said separator means when said protective cover is mounted on said separator means.

4. A deflection yoke claimed in claim 1, wherein said protective cover has a side open toward said substrate and an edge of said side is in contact with said separator means when said protective cover is mounted on said separator means.

5. A deflection yoke claimed in claim 2, wherein said protective cover has a side open toward said substrate and an edge of said side is located close to said separator means when said protective cover is mounted on said separator means.

6. A deflection yoke claimed in claim 2, wherein said protective cover has a side open toward said substrate and an edge of said side is in contact with said separator means when said protective cover is mounted on said separator means.

7. A deflection yoke claimed in claim 2, wherein said protective cover has contact means for contacting said substrate when said protective cover is coupled to said substrate by said third coupling means, and said third coupling means and said contact means are substantially simultaneously in contact with said substrate when said protective cover is about to couple with said substrate by said third coupling means and by turning said protective cover toward said substrate under a condition that said first end is coupled to one of said first and second flanges.

8. A deflection yoke claimed in claim 1, wherein said first end is coupled to said first flange and said second end is coupled to said second flange.

9. A deflection yoke claimed in claim 1, wherein said first end is coupled to said second flange and said second end is coupled to said first flange.

10. A deflection yoke claimed in claim 1, wherein said first end is coupled to said first flange and an extended portion of said second end is coupled to said second flange.

11. A deflection yoke claimed in claim 1, wherein said first end is coupled to said second flange and an extended portion of said second end is coupled to said first flange.

12. A deflection yoke claimed in claim 1, wherein an extended portion of said first end is coupled to said first flange and said second end is coupled to said second flange.

13. A deflection yoke claimed in claim 1, wherein an extended portion of said first end is coupled to said second flange and said second end is coupled to said first flange.

* * * * *